US011473174B2

(12) United States Patent
Tokuda et al.

(10) Patent No.: US 11,473,174 B2
(45) Date of Patent: Oct. 18, 2022

(54) COATED STEEL PRODUCT

(71) Applicant: NIPPON STEEL CORPORATION, Tokyo (JP)

(72) Inventors: Kohei Tokuda, Tokyo (JP); Hisashi Baba, Tokyo (JP); Nobuyuki Shimoda, Tokyo (JP); Kenichiro Matsumura, Tokyo (JP); Yasuto Goto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 511 days.

(21) Appl. No.: 16/477,987

(22) PCT Filed: Jan. 16, 2017

(86) PCT No.: PCT/JP2017/001286
§ 371 (c)(1),
(2) Date: Jul. 15, 2019

(87) PCT Pub. No.: WO2018/131171
PCT Pub. Date: Jul. 19, 2018

(65) Prior Publication Data

US 2019/0368007 A1 Dec. 5, 2019

(51) Int. Cl.
*C22C 21/06* (2006.01)
*C23C 2/12* (2006.01)
*C23C 28/02* (2006.01)

(52) U.S. Cl.
CPC ..... *C22C 21/06* (2013.01); *C23C 2/12* (2013.01); *C23C 28/021* (2013.01); *C22C 2200/06* (2013.01)

(58) Field of Classification Search
None
See application file for complete search history.

(56) References Cited

U.S. PATENT DOCUMENTS 6,465,114 B1 * 10/2002 Honda ..... C23C 2/06 428/659
2011/0274945 A1 * 11/2011 Shimoda ..... C23C 2/06 427/398.1

(Continued)

FOREIGN PATENT DOCUMENTS

CN 106103784 A 11/2016
EP 2821520 A1 * 1/2015 ..... C23C 2/30

(Continued)

OTHER PUBLICATIONS

JP 2001-316791 machine translation (Year: 2001).*

(Continued)

*Primary Examiner* — Paul A Wartalowicz
*Assistant Examiner* — Stephani Hill
(74) *Attorney, Agent, or Firm* — Solaris Intellectual Property Group, PLLC

(57) ABSTRACT

The present invention provides a coated steel product including: a steel product; a coating layer that is coated on the surface of the steel product and that includes from 8 to 50% by mass of Mg, from 2.5 to 70.0% by mass of Al, and from 0.30 to 5.00% by mass of Ca, with the balance consisting of Zn and impurities; and an intermediate layer interposed between the steel product and the coating layer, in which the intermediate layer has a sea-island structure constituted by a sea portion composed of an Al—Fe alloy phase, and island portions including a Zn—Mg—Al alloy phase having a Mg content of 8% by mass or more, and in which the sea portion composed of the Al—Fe alloy phase has an area fraction of from 55 to 90%.

11 Claims, 4 Drawing Sheets

(56) References Cited

U.S. PATENT DOCUMENTS

| | | | | |
|---|---|---|---|---|
| 2012/0135271 | A1* | 5/2012 | Ooi | C22C 21/10 428/653 |
| 2015/0368778 | A1 | 12/2015 | Allely et al. | |
| 2017/0100915 | A1 | 4/2017 | Tokuda | |
| 2018/0320260 | A1* | 11/2018 | Oh | C23C 2/20 |
| 2019/0218639 | A1* | 7/2019 | Scott | C23C 2/40 |

FOREIGN PATENT DOCUMENTS

| | | | | | |
|---|---|---|---|---|---|
| JP | 9-256134 | A | | 9/1997 | |
| JP | 11-117052 | A | | 4/1999 | |
| JP | 2000-104154 | A | | 4/2000 | |
| JP | 2001316791 | A | * | 11/2001 | C23C 28/025 |
| JP | 2002060978 | A | * | 2/2002 | |
| JP | 2010-70810 | A | | 4/2010 | |
| JP | 2011-144429 | A | | 7/2011 | |
| JP | 2015-40334 | A | | 3/2015 | |
| JP | 5785336 | B1 | | 9/2015 | |
| JP | 2016-514202 | A | | 5/2016 | |
| WO | WO 2014/122507 | A1 | | 8/2014 | |
| WO | WO 2015/145721 | A1 | | 10/2015 | |

OTHER PUBLICATIONS

Lyons. Chapter 43 Zinc. ICE manual of construction materials vol. 2. 2009. 519-525. (Year: 2009).*

EP 2821520 machine translation (Year: 2015).*

Li et al. Effect of heat invasion time and temperature on mechanical properties of RE alloy coatings. Gongneng Cailiao (2018), 49(12), 12096-12100 (Year: 2018).*

JP 2002-060978 machine translation (Year: 2002).*

International Search Report for PCT/JP2017/001286 dated Feb. 7, 2017.

Written Opinion of the International Searching Authority for PCT/JP2017/001286 (PCT/ISA/237) dated Feb. 7, 2017.

* cited by examiner

[Fig. 1]
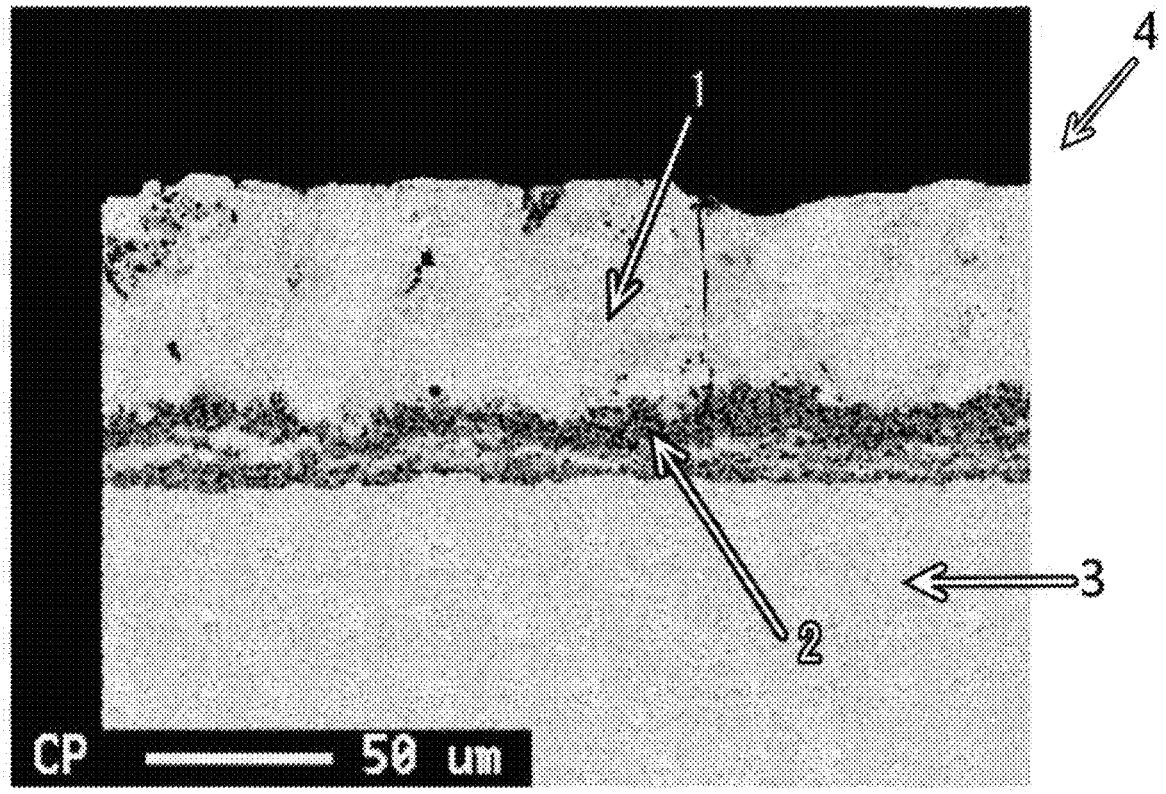

[Fig. 2]
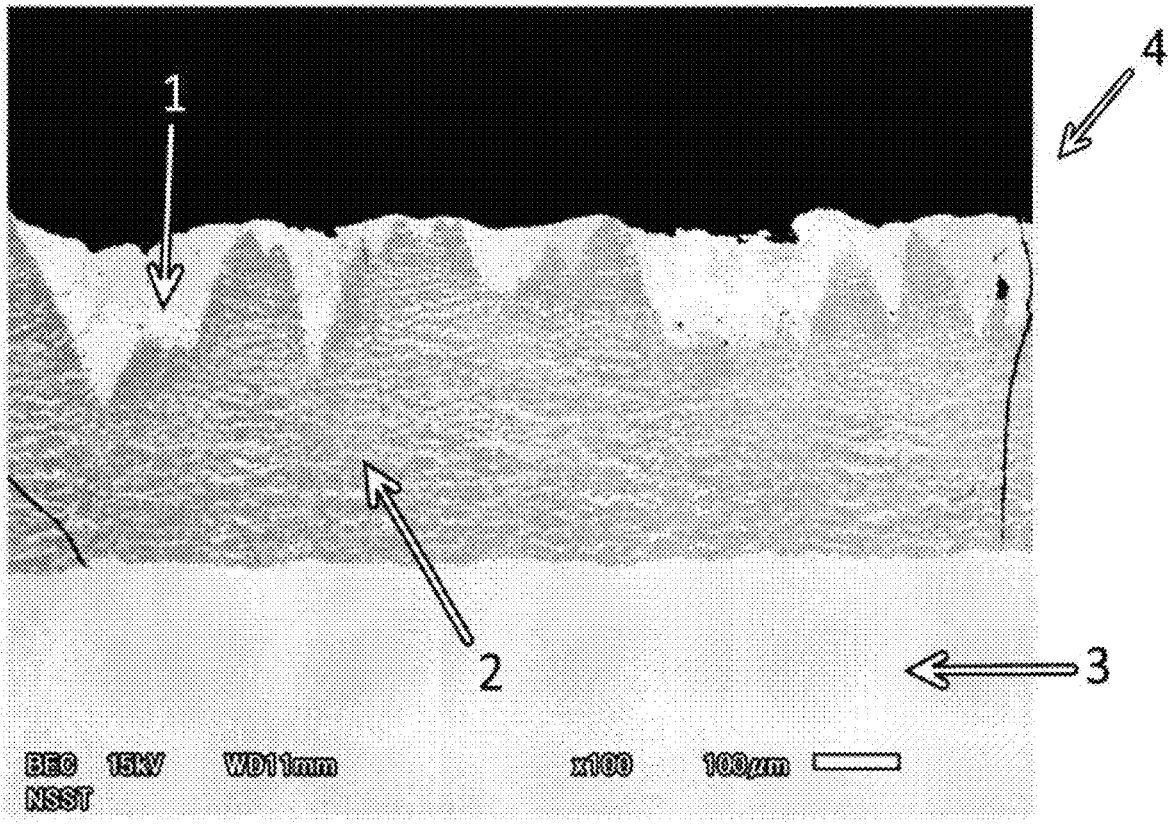

[Fig. 3]
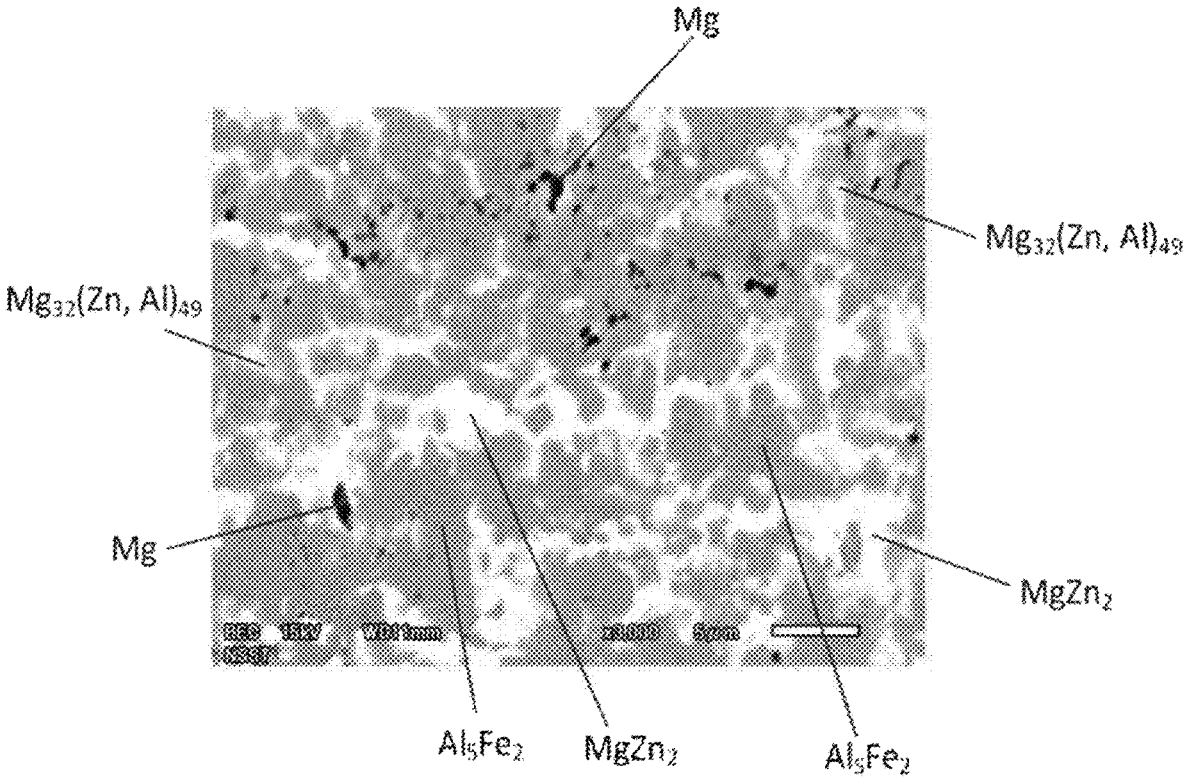
[Fig. 4]
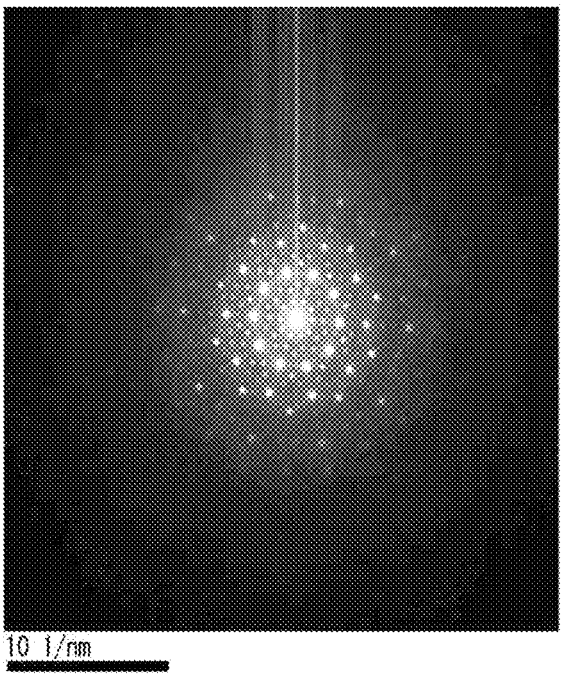

[Fig. 5]
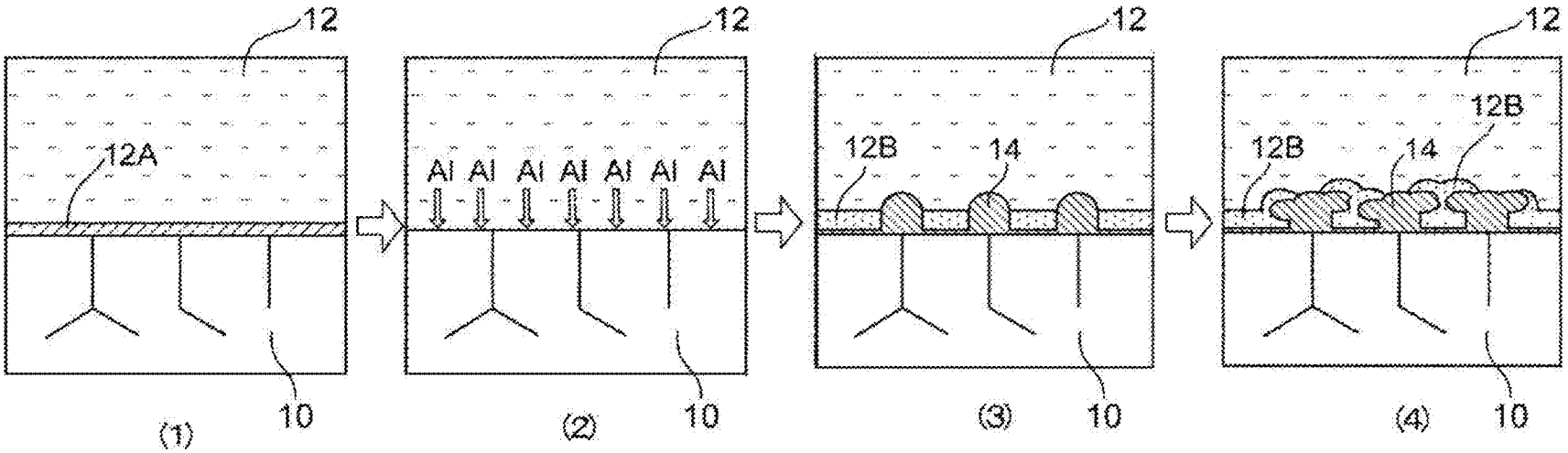

COATED STEEL PRODUCT

TECHNICAL FIELD

The present disclosure relates to a coated steel product.

BACKGROUND ART

In the fields of civil engineering and building materials, for example, Zn-based coated steel products are used as steel products having various shapes, such as, for example, fence conduits, corrugated pipes, drain covers, sheets for preventing blown sands, bolts, wire meshes, guardrails and cutoff walls. Zn-based coating layers of Zn-based coated steel products are exposed to harsh corrosive environments, and thus required to have an effect of protecting a base metal (steel product) from corrosion. Further, Zn-based coating layers are required to have impact resistance and wear resistance for protecting the base metal from flying objects, earth and sand, and the like, in addition to corrosion resistance.

To meet such performance requirements, Zn—Al—Mg-based hot-dip coated steel products are proposed, for example, in Patent Document 1, Patent Document 2, Patent Document 3, and the like. By incorporating a small amount of Mg into a Zn—Al-based alloy coating layer, it is possible to obtain a higher corrosion resistance and a long-term rust-prevention effect. In general, when a Zn—Al-based coating layer has an Al content of less than 20% by mass, the coating layer is mainly formed of a soft Zn phase or Al phase. Accordingly, such a Zn—Al-based coating layer is less resistant to damage, impacts and the like, and is susceptible to abrasion. In contrast, a Zn—Mg—Al-based alloy coating layer containing Mg has an increased hardness, and thus is advantageous in terms of impact resistance and wear resistance.

Patent Document 4 discloses a technique which enables to prolong a service life of a coated steel product, by increasing a thickness of an intermediate layer (Al—Fe alloy layer) in a Zn—Al—Mg-based hot-dip coated steel product. Since, in the coated steel product disclosed in Patent Document 4, the intermediate layer (Al—Fe alloy layer) is hard, and the thickness of an entire hot-dip coating layer is increased, the resulting coated steel product has a higher impact resistance and wear resistance, and thus is more advantageous in terms of protecting the base metal (steel product).

Further, Patent Document 5 discloses a steel product hot-dip coated with a Zn—Mg—Al-based alloy, which includes a Zn—Mg—Al-based alloy coating layer containing a large amount of Mg. Due to containing a large amount of Mg, the coating layer of this hot-dip coated steel product contains a number of intermetallic compounds, which provide an increased hardness, a high corrosion resistance and wear resistance to the coated steel product.

Patent Document 1: Japanese Patent Application Laid-Open (JP-A) No. H09-256134

Patent Document 2: JP-A No. H11-117052

Patent Document 3: JP-A No. 2010-70810

Patent Document 4: JP-A No. 2015-40334

Patent Document 5: Japanese Patent No. 5785336 B

SUMMARY OF INVENTION

Technical Problem

As described above, a coating layer included in a coated steel product is required to have impact resistance and wear resistance for protecting the base metal from flying objects, earth and sand, and the like.

However, in the hot-dip coated steel products disclosed in Patent Documents 1 to 3, activity of Fe is decreased, during the formation of the Zn—Al—Mg-based alloy coating layer containing a large amount of Mg. Further, wettability and reactivity between the base metal (steel product) and the hot-dip coating bath are also deteriorated. As a result, there is a case in which the growth of the intermediate layer (Al—Fe alloy layer) is deteriorated, and a case in which the reactivity with a flux is altered to result in a failure to sufficiently reduce the base metal (steel product), making it difficult to form a Zn—Al—Mg-based alloy coating layer having a favorable appearance (namely, to produce a steel product hot-dip coated with a Zn—Al—Mg-based alloy and having a favorable appearance). In other words, in hot-dip coating using a Zn—Al—Mg-based alloy coating bath which contains a large amount of Mg, it has been unable to ensure a sufficient thickness and structure of the resulting Zn—Al—Mg-based alloy coating layer.

Accordingly, hot-dip coating has been carried out only within a limited concentration range of Mg component, which adversely affects hot-dip coating performance (specifically, within a limited Mg content range of 5% by mass or less). Further, a two-stage coating method has been used, so that a sufficient thickness and adhesion of the coating layer can be ensured even in the absence of the intermediate layer.

Therefore, in the present circumstances, the hot-dip coated steel products disclosed in Patent Documents 1 to 3 do not have sufficient corrosion resistance, impact resistance and abrasion resistance.

In the hot-dip coated steel product disclosed in Patent Document 4, the intermediate layer (Al—Fe alloy layer) has an increased thickness. As a result, when the intermediate layer (Al—Fe alloy layer) is corroded, spot-like red rust occurs noticeably due to dissolution of Fe component, revealing that the coated steel product does not have a sufficient corrosion resistance, in the present circumstances.

The hot-dip coated steel product disclosed in Patent Document 5 has a high corrosion resistance and wear resistance. However, since the coating layer in the coated steel product contains a large amount of Mg, the reactivity with the base metal (steel product) is reduced during the formation of the coating layer, leading to a failure to form the intermediate layer (Al—Fe alloy layer), or making it difficult to increase the thickness of the intermediate layer (Al—Fe alloy layer). Therefore, the resulting coating layer tends to have a low thickness and a low impact resistance, and when cracks occur in the coating layer due to impact, the cracks immediately reach the steel product (base metal), making the coating layer susceptible to peeling. Further, once damage or cracks occur in the coating layer due to flying objects, earth and sand, or the like, the corrosion is more likely to progress, resulting in a reduced corrosion resistance, in the present circumstances.

One embodiment of the present disclosure has been done in view of the above described background, and an object thereof is to provide a coated steel product which has a high corrosion resistance, impact resistance, and wear resistance, as well as a high corrosion resistance after the occurrence of damage or cracks in the coating layer.

Solution to Problem

The present disclosure has been made in view of the above described background, and includes the following embodiments.

<1> A coated steel product comprising:

a steel product;

a coating layer that is coated on a surface of the steel product, and that comprises, by mass, from 8 to 50% of Mg, from 2.5 to 70.0% of Al, from 0.30 to 5.00% of Ca, from 0 to 3.50% of Y, from 0 to 3.50% of La, from 0 to 3.50% of Ce, from 0 to 0.50% of Si, from 0 to 0.50% of Ti, from 0 to 0.50% of Cr, from 0 to 0.50% of Co, from 0 to 0.50% of Ni, from 0 to 0.50% of V, from 0 to 0.50% of Nb, from 0 to 0.50% of Cu, from 0 to 0.50% of Sn, from 0 to 0.20% of Mn, from 0 to 0.50% of Sr, from 0 to 0.50% of Sb, from 0 to 0.50% of Cd, from 0 to 0.50% of Pb, and from 0 to 0.50% of B, with a balance consisting of Zn and impurities, wherein the following Formula (A) and the following Formula (B) are satisfied:

$$Si+Ti+Cr+Co+Ni+V+Nb+Cu+Sn+Mn+Sr+Sb+Cd+Pb+B \leq 0.50\% \quad \text{Formula (A):}$$

$$Ca+Y+La+Ce \leq 5.00\% \quad \text{Formula (B):}$$

wherein, in Formula (A) and Formula (B), symbols of respective elements represent contents of the respective elements in % by mass; and an intermediate layer interposed between the steel product and the coating layer, wherein the intermediate layer has a sea-island structure constituted by a sea portion composed of an Al—Fe alloy phase, and island portions including a Zn—Mg—Al alloy phase having a Mg content of 8% by mass or more, and wherein the sea portion composed of the Al—Fe alloy phase has an area fraction of from 55 to 90%.

<2> The coated steel product according to <1>, wherein the intermediate layer has a thickness of from 5 to 500 μm.

<3> The coated steel product according to <1> or <2>, wherein the sea portion is composed of $Al_5Fe_2$ phase as the Al—Fe alloy phase, and wherein the island portions are composed of a quasicrystal phase as the Zn—Mg—Al alloy phase, and $MgZn_2$ phase, or composed of the quasicrystal phase as the Zn—Mg—Al alloy phase, the $MgZn_2$ phase, and Mg phase.

<4> The coated steel product according to any one of c<1> to <3>, wherein a ratio of a thickness of the intermediate layer to a thickness of the coating layer is from 0.2 to 4.

<5> The coated steel product according to any one of <1> to <4>, wherein the Mg content in the coating layer is 15% by mass or more, and the Mg content in the Zn—Mg—Al alloy phase is 15% by mass or more.

<6> The coated steel product according to any one of <1> to <5>, wherein the coating layer is a hot-dip coating layer.

Advantageous Effects of Invention

According to one embodiment of the present disclosure, it is possible to provide a coated steel product which has a high corrosion resistance, impact resistance, and wear resistance, as well as a high corrosion resistance after the occurrence of damage or cracks in the coating layer.

BRIEF DESCRIPTION OF DRAWINGS

FIG. 1 is a cross-sectional photograph showing one example of a coated steel product according to an embodiment of the present disclosure.

FIG. 2 is a cross-sectional photograph showing another example of the coated steel product according to the embodiment of the present disclosure.

FIG. 3 is an SEM backscattered electron image showing one example of an intermediate layer in the coated steel product according to the embodiment of the present disclosure.

FIG. 4 is a TEM electron beam diffraction image of a quasicrystal phase.

FIG. 5 is a schematic diagram for explaining an estimated mechanism responsible for the formation of the intermediate layer having a sea-island structure, in the coated steel product according to the embodiment of the present disclosure.

DESCRIPTION OF EMBODIMENTS

A coated steel product according an embodiment which is one example of the present disclosure, and a production method thereof will now be described.

In the present specification, any numerical range indicated using an expression "from * to" represents a range in which numerical values described before and after the "to" are included in the range as a lower limit value and an upper limit value.

Further, in the present specification, the symbol "%" used to describe the content of a composition (element) represents the content thereof in "% by mass".

(Coated Steel Product)

The coated steel product according to the embodiment includes: a steel product; a coating layer coated on the surface of the steel product; and an intermediate layer interposed between the steel product and the coating layer (see FIG. 1 and FIG. 2).

The coating layer includes, by mass, from 8 to 50% of Mg, from 2.5 to 70.0% of Al, and from 0.30 to 5.00% of Ca, with the balance consisting of Zn and impurities. The intermediate layer has a sea-island structure constituted by a sea portion composed of an Al—Fe alloy phase, and island portions including a Zn—Mg—Al alloy phase having a Mg content of 8% or more, and the sea portion composed of the Al—Fe alloy phase has an area fraction of from 55 to 90.

In each of FIG. 1 and FIG. 2, reference numeral 1 indicates the coating layer, reference numeral 2 indicates the intermediate layer, reference numeral reference numeral 3 indicates the steel product, and reference numeral 4 indicates the coated steel product.

Due to having the above described constitution, the coated steel product according to the embodiment has a high corrosion resistance, impact resistance, and wear resistance, as well as a high corrosion resistance after the occurrence of damage or cracks in the coating layer. The coated steel product according to the embodiment has been found based on the findings shown below.

First, the present inventors investigated for forming a coating layer having an excellent corrosion resistance, impact resistance and wear resistance, using, as an example, a dip coating method in which a "Zn—Mg—Al-based alloy coating bath containing Mg at a high concentration of 8% or more" (hereinafter, also referred to as "high Mg concentration coating bath") is used. Further, the inventors investigated for enhancing the corrosion resistance of an intermediate layer which is formed by an alloying reaction between Al and Fe, in order to enhance the corrosion resistance of the resulting coated steel product, even after the occurrence of damage or cracks in the coating layer. Specifically, the investigation has been done as follows.

The coating layer produced by hot-dip coating using the high Mg concentration coating bath contains Mg at a high concentration of 8% or more. Therefore, the corrosion resistance of the coating layer is increased. In addition, the coating layer itself becomes hard, and thus, the impact resistance and wear resistance of the coating layer are also increased. However, an alloying reactivity of Al with Fe (namely, the reactivity of Al as a coating component with Fe as a base metal (steel product) component: hereinafter, this reaction is also referred to as "Al—Fe reaction") tends to be reduced during the hot-dip coating, and this makes it difficult to increase the thickness of the intermediate layer. Accordingly, the resulting coating layer has a low impact resistance, and the coating layer is susceptible to peeling due to impact.

Therefore, the inventors investigated for accelerating the alloying reaction of Al with Fe, in the hot-dip coating using the high Mg concentration coating bath. As a result, the inventors obtained the following findings, the details of which are to be described later. By accelerating the alloying reaction of Al with Fe during the hot-dip coating, an Al—Fe alloy phase is formed so as to surround portions of coating components including Zn, Mg and Al. This results in the formation of alloy phases which include at least a Zn—Mg—Al alloy phase, and which are interspersed in the Al—Fe alloy phase, like islands. The alloy phases interspersed like islands are formed from the high Mg concentration coating bath. In other words, the intermediate layer having a sea-island structure constituted by a sea portion composed of an Al—Fe alloy phase, and island portions including a Zn—Mg—Al alloy phase having a Mg content of 8% or more, is formed so as to be interposed between the base metal (steel product) and the coating layer.

The inventors have found out that the intermediate layer which has the above described sea-island structure, and in which the sea portion composed of the Al—Fe alloy phase has an area fraction of from 55 to 90%, has the following properties.

1) Due to having the sea-island structure, the corrosion in the intermediate layer proceeds in complicated paths, and the corrosion resistance of the intermediate layer itself is increased (namely, the corrosion is less likely to progress, even when damage or cracks occur in the coating layer and the intermediate layer reaches a corrosion stage).

2) Since the intermediate layer contains a number of corrosion resistant elements, such as Mg and Zn, the effect of sacrificial corrosion protection provided by the corrosion resistant elements serves to enhance the corrosion resistance of the intermediate layer itself (namely, red rust is less likely to occur, even when damage or cracks occur in the coating layer and the intermediate layer reaches the corrosion stage).

3) The sea-island structure provides a hardness distribution in the intermediate layer, which leads to a complicated crack propagation behavior, making the coating layer less susceptible to peeling, even when exposed to impact by flying object, earth and sand, or the like.

Based on the above described findings, it has been found out that the coated steel product according to the embodiment has a high corrosion resistance, impact resistance, and wear resistance, as well as a high corrosion resistance after the occurrence of damage or cracks in the coating layer.

The coated steel product according to the embodiment will now be described in detail.

The steel product will be described.

The shape of the steel product is not particularly limited. Examples of the steel product include those formed into: steel sheets, steel pipes, civil engineering and construction materials (such as fence conduits, corrugated pipes, drain covers, sheets for preventing blown sands, bolts, wire meshes, guardrails and cutoff walls), members for home electric appliances (such as casings for outdoor units of air conditioners), and automotive parts (such as undercarriage members). The formation of the steel product can be carried out using various types of deformation processing methods, such as press working, roll forming and bending.

The material of the steel product is not particularly limited. As the steel product, it is possible to use various types of steels such as general steels, Ni-pre-coated steels, Al-killed steels, ultra-low carbon steels, high carbon steels, various types of high tensile steels, and some of high alloy steels (steels containing strengthening elements, such as Ni and Cr, and the like).

Conditions for steelmaking methods of the steel product, methods of producing steel sheets (such as a hot rolling method, a pickling method, and a cold rolling method), and the like are also not particularly limited.

However, a crystal grain size of the surface (the surface on which the coating layer and the intermediate layer are to be formed) of the steel product is preferably less than 5 μm, and more preferably less than 1 μm. By decreasing the crystal grain size of the surface of the steel product, the "Al—Fe reaction" during hot-dip coating is accelerated, as a result of which the formation of the intermediate layer having the above described sea-island structure is facilitated. Although a smaller crystal grain size of the surface of the steel product is more preferred, a realistic lower limit value to which the crystal grain size can be minimized is about 0.1 μm. It is noted here that having a large crystal grain size has no advantage in terms of reactivity with the coating layer.

The crystal grain size of the surface of the steel product as used herein refers to a mean value of the size of crystal grains in a ferrite phase, which is included in a region within the range of 100 μm from the surface in a depth direction. The crystal grain size is measured in accordance with "Steels—Micrographic Determination of the Apparent Grain Size" defined in JIS G0551.

The steel product may be subjected to a processing so as to increase a dislocation density of the surface thereof (the surface on which the coating layer and the intermediate layer are to be formed). By increasing the dislocation density of the surface of the steel product, the "Al—Fe reaction" during hot-dip coating is accelerated, as a result of which the formation of the intermediate layer having the above described sea-island structure is facilitated.

Further, the steel product may be a coated steel product, such as a Cu—Sn-substituted coated steel product, an Ni-substituted coated steel product, or a Zn-coated steel product (a coated steel product in which the amount of Zn deposited is 40 g/m$^2$ or less). By using any of these coated steel products as the steel product, the "Al—Fe reaction" during hot-dip coating is accelerated, as a result of which the formation of the intermediate layer having the above described sea-island structure is facilitated. In a case in which a coated steel product as described above is used as the steel product, a Cu—Sn-enriched layer, an Ni-enriched layer, a Zn—Al—Fe alloy layer or the like may be formed between the steel product and the intermediate layer to be described later, to a thickness corresponding to the thickness of the original coating in the steel product used. Such a layer is formed when the surface of coated steel product reacts with a component(s) of a hot-dip coating bath, for some reasons, to cause the component(s) to be incorporated into the Al—Fe alloy phase and to remain between the steel product and the intermediate layer. However, there is a case in which such a layer is not observed, since the layer usually diffuses as soon as the steel product is dipped into the coating bath.

The intermediate layer will now be described.

The intermediate layer is a layer formed between the coating layer and steel product, by the reaction of Al as a coating component with Fe in the steel product (base metal) during the formation of the coating layer, and is formed while generating an Al—Fe alloy phase as well as incorporating coating components thereinto. Accordingly, the composition of the intermediate layer includes Zn, Mg, Al, Ca and Fe, with the balance consisting of impurities (however, there is a case in which Ca is not contained). Specifically, the composition of the intermediate layer preferably includes from 3.0 to 30.0% of Zn, from 0.5 to 25.0% of Mg, from 30.0 to 55.0% of Al, from 0 to 3.0% of Ca, and from 24.0 to 40.0% of Fe, with the balance consisting of impurities. In the present embodiment, a region containing from 24.0 to 40.0% of Fe, within the layers coating the steel product, is defined as the "intermediate layer".

It is noted that there is a case in which the intermediate layer contains "elements (such as Y, La, Ce, and Si) other than Zn, Mg, Al, Ca, and impurities" which can be contained in the coating layer. However, the elements (including impurities) other than Zn, Mg, Al, and Ca in the intermediate layer are always contained in an amount of less than 0.5%, and are thus regarded as impurities.

The composition (contents of the respective elements) of the intermediate layer is measured by the following method. A backscattered electron image of an arbitrary cross section of the intermediate layer (a cross section obtained by cutting the intermediate layer in a thickness direction thereof) is captured, using an SEM (scanning microscope) equipped with an EPMA (electron beam micro analyzer). On the thus obtained SEM backscattered electron image, a rectangular region is selected from the interior of the intermediate layer. The size and the position of this rectangular region are set such that the region is located within the intermediate layer. Specifically, the rectangular region is set such that an upper side and a bottom side thereof are substantially parallel to the surface of the steel product, and a length of one side is 10 μm. The position of the rectangular region is set such that both of these two sides are located inside the intermediate layer, and that a distance between both sides is maximized. Further, the rectangular region is selected so as to include both the sea portion and the island portions to be described later. In addition, the position of the rectangular region is selected such that a difference in the area fraction of the sea portion in the rectangular region with respect to the area fraction of the sea portion in the entire intermediate layer is within ±5%. A number of 20 or more of the rectangular regions which satisfy these requirements are selected. The respective rectangular regions are quantitatively analyzed by EPMA, and the mean values of the contents of respective elements determined in the respective rectangular regions, are defined as the contents of the respective elements in the intermediate layer.

The thickness of the intermediate layer, the area fraction of the sea portion in the intermediate layer, and the area fraction of the sea portion in each rectangular region are measured by the methods to be described later.

A metallographic structure of the intermediate layer has a sea-island structure constituted by the sea portion composed of an Al—Fe alloy phase, and the island portions including a Zn—Mg—Al alloy phase. Specifically, the metallographic structure of the intermediate layer has a structure in which a plurality of "phases including a Zn—Mg—Al alloy phase" (island portions) are surrounded by an Al—Fe alloy phase (sea portion), when a cross section obtained by cutting the intermediate layer in the thickness direction thereof is observed (see FIG. 3).

The sea portion is a region composed of an Al—Fe alloy phase. The Al—Fe alloy phase is composed of $Al_5Fe_2$ phase. It is noted that, during the reaction in which the $Al_5Fe_2$ phase is formed (namely, the reaction of Al as a coating component with Fe in the steel product (base metal)), there is a case in which Zn is incorporated into the $Al_5Fe_2$ phase, in such a form that Al in the $Al_5Fe_2$ phase is substituted with Zn in the coating components. Accordingly, Zn may be partially interspersed in the sea portion.

In the present embodiment, the regions other than the sea portion, in the intermediate layer, are referred to as "island portions". The island portions include, for example, a Zn—Mg—Al alloy phase, a Zn—Mg alloy phase, and a metal phase such as Mg phase. Each of these alloy and metal phases is a quasicrystal phase or an equilibrium phase.

Examples of the Zn—Mg—Al alloy phase include a quasicrystal phase "$Mg_{32}(Zn, Al)_{49}$". Further, a portion of Zn in the Zn—Mg—Al alloy phase may be substituted with Al.

Examples of the Zn—Mg alloy phase include $MgZn_2$ phase.

The island portions are preferably regions composed of two or three of these phases. Specifically, the island portions are preferably regions composed of a quasicrystal phase and $MgZn_2$ phase, or regions composed of the quasicrystal phase, $MgZn_2$ phase, and Mg phase.

Further, the quasicrystal phase "$Mg_{32}(Zn, Al)_{49}$" may contain Ca, in addition to Mg, Zn and Al. Further, the $MgZn_2$ phase, which is a Zn—Mg alloy phase, may contain at least one of Ca or Al, in addition to Mg and Zn. The Mg phase, which is a metal phase, may contain Zn, in addition to Mg. Further, the respective phases constituting the island portions may contain Fe, impurities, and the like.

The island portions may include 10% or less, in terms of area fraction in the intermediate layer, of a balance structure which is a non-equilibrium phase, in addition to the above described alloy and metal phases which are each a quasicrystal phase or an equilibrium phase. Examples of the balance structure include unstable Mg—Zn alloy phases such as MgZn phase, $Mg_2Zn_3$ phase, and $Mg_{51}Zn_{20}$ phase. When the content of the balance structure is 10% or less, in terms of area fraction, the properties of the intermediate layer are not greatly impaired.

In a case in which the island portions include a plurality of phases, each of the island portions may be constituted by a plurality of phases, or may be constituted by a single phase. Specifically, for example, an island portion(s) (each) composed of the quasicrystal phase "$Mg_{32}(Zn, Al)_{49}$", $MgZn_2$ phase, and Mg phase; an island portion(s) (each) composed of two phases of the above described three phases; and an island portion(s) (each) composed of a single phase of the above described three phases; may be present in a mixed state.

In the island portions, the Zn—Mg—Al alloy phase (the quasicrystal phase "$Mg_{32}(Zn, Al)_{49}$") has a Mg content of 8% or more. When the island portions include the Zn—Mg—Al alloy phase having a Mg content of 8% or more, the corrosion resistance of the intermediate layer is improved. From this viewpoint, the Zn—Mg—Al alloy phase preferably has a Mg content of 10% or more, and more preferably 15% or more. At the same time, the upper limit of the Mg content in the Zn—Mg—Al alloy phase is preferably 50% or less, from the viewpoint of maintaining an appropriate corrosion speed.

Further, when the Mg content in the Zn—Mg—Al alloy phase is 15% or more, the Mg content in the coating layer is also preferably 15% or more, from the viewpoint of improving the corrosion resistance of both the intermediate layer and the coating layer.

It is also preferred that a phase which is other than the Zn—Mg—Al alloy phase and which constitutes the island portions (such as a Mg—Zn alloy phase) also has a Mg content of 8% or more, more preferably 10% or more, and still more preferably 15% or more, from the viewpoint of improving the corrosion resistance of the intermediate layer.

The Mg content of each phase can be calculated by a quantitative analysis using TEM-EDX (Transmission Electron Microscope-Energy Dispersive X-ray Spectroscopy), or by a quantitative analysis using EPMA (Electron Probe Micro-Analyzer) mapping. Specifically, a quantitative analysis for determining the Mg content in each phase, using TEM-EDX or EPMA, is carried out at three locations, in an arbitrary cross section of the intermediate layer to be measured (namely, a cross section obtained by cutting the intermediate layer in the thickness direction thereof), and the mean value of the values determined in the three locations is defined as the Mg content of each phase.

In the sea-island structure of the intermediate layer, the area fraction of the sea portion composed of the Al—Fe alloy phase (namely, the area fraction of the Al—Fe alloy phase) is from 55 to 90%. This is because, when the area ratio of the Al—Fe alloy phase is less than 55%, the area of the island portions is increased, resulting in a failure to maintain the sea-island structure of the intermediate layer. Therefore, the area fraction of the sea portion is set to 55% or more. The sea-island structure is maintained by ensuring an appropriate area fraction of the "island portions including a Zn—Mg—Al alloy phase" surrounded by the sea portion. As a result, the corrosion in the intermediate layer proceeds in complicated paths, and the corrosion resistance of the intermediate layer itself is increased, thereby enabling to prevent the peeling of the coating layer. Further, by incorporating a large amount of corrosion resistant elements such as Mg and Zn into the intermediate layer, the corrosion resistance of the intermediate layer itself is increased.

In order to incorporate a large amount of corrosion resistant elements such as Mg and Zn into the intermediate layer, the ratio of the island portions containing corrosion resistant elements such as Mg and Zn needs to be maintained constant. Therefore, the area fraction of the sea portion is set to 90% or less.

From the above described viewpoints, the sea portion preferably has an area fraction of from 65 to 85%, and more preferably from 70 to 80%.

The area fraction of the island portion is a value obtained by subtracting the area fraction of the sea portion from 100%. The respective phases constituting the island portions have a low correlation to the components of the coating bath, since the respective phases are formed at irregular area fractions due to complicated formation behavior of the sea-island structure. Accordingly, the area fractions of the respective phases constituting the island portions are not particularly limited.

In the sea-island structure of the intermediate layer, the area fraction of the sea portion composed of the Al—Fe alloy phase (namely, the area fraction of the Al—Fe alloy phase) is measured by the following method.

An arbitrary cross section of the intermediate layer to be measured (namely, a cross section obtained by cutting the intermediate layer in the thickness direction thereof) is subjected to CP (cross section polisher) processing, which is one kind of ion milling method. After the CP processing, backscattered electron images of the cross section of the intermediate layer (namely, images (each having a size of about 30 μm×30 μm) obtained by observing three or more locations selected from an arbitrary region having a size of about 2,000 μm×2,000 μm in the cross section of the intermediate layer, at a magnification of 3,000-fold) are obtained using an SEM (scanning electron microscope).

Next, the same arbitrary cross section of the intermediate layer to be measured (namely, the cross section obtained by cutting the intermediate layer in the thickness direction thereof) is subjected to FIB (focused ion beam) processing. After the FIB processing, TEM (transmission electron microscope) electron diffraction images of the cross-sectional structure of the intermediate layer are obtained. Thereafter, intermetallic compounds contained in the intermediate layer are identified.

Subsequently, the SEM backscattered electron images are compared with the identification results of the TEM electron diffraction images, and respective phases in the intermediate layer are identified in the SEM backscattered electron images. In the identification of the respective phases in the intermediate layer, it is preferred to carry out an EDX point analysis using an SEM equipped with an EDX (Energy dispersive X-ray spectrometer), and to compare the results of the EDX point analysis and the identification results of the TEM electron diffraction images.

Thereafter, in each SEM backscattered electron image, values of three parameters, namely, brightness, hue, and contrast, in gray scale, of each phase in the intermediate layer are determined. Since these three parameter values of brightness, hue, and contrast of each phase reflect the atomic numbers of the elements contained in each phase, a phase having a higher content of Mg and a smaller atomic number tends to display a black color, and a phase having a higher content of Zn tends to display a white color, in general.

Accordingly, computer image processing is carried out in such a manner that changes occur only in the values of the above described three color parameters of the Al—Fe alloy phase, so as to match with the SEM backscattered electron image. Based on the result of this image processing, the area fraction of the Al—Fe alloy phase in each SEM backscattered electron image is determined.

The area fraction of the Al—Fe alloy phase is determined at least in three or more visual fields in an arbitrary cross section of the intermediate layer (namely, a cross section obtained by cutting the intermediate layer in the thickness direction thereof) by the above described procedure, and the mean value of the values determined in the visual fields is defined as the area fraction of the Al—Fe alloy phase.

Further, the area fractions of the respective phases (such as the Zn—Mg—Al alloy phase, the Zn—Mg alloy phase, and the metal phase) constituting the island portions can also be determined by the same procedure as described above.

FIG. 3 shows one example of the SEM backscattered electron images of the intermediate layer. In the SEM backscattered electron image of the intermediate layer shown in FIG. 3, white portions indicate $MgZn_2$ phase (denoted as $MgZn_2$ in FIG. 3), light grey portions indicate the quasicrystal phase "$Mg_{32}(Zn, Al)_{49}$ phase" (denoted as $Mg_{32}(Zn, Al)_{49}$ in FIG. 3), dark grey portions indicate $Al_5Fe_2$ phase (denoted as $Al_5Fe_2$ in FIG. 3), and black portions indicate Mg phase (denoted as Mg in FIG. 3). The chemical compositions of the respective phases as determined by an SEM equipped with an EDX are as follows.

White portions=$MgZn_2$ phase: chemical composition=Mg: 13%, Al: 3%, Ca: 5%, Zn: 79%

Light grey portions=quasicrystal phase, $Mg_{32}(Zn, Al)_{49}$: chemical composition=Mg: 20.4%, Zn: 75.5%, Al: 3%, Ca: 1%

Dark grey portions=$Al_5Fe_2$ phase: chemical composition=Al: 52.5%±5%, Fe: 44%±5%, Zn: 3.5%±1%

Black portions=Mg phase: chemical composition=Mg: 94%, Zn: 6%

In the SEM backscattered electron image of the intermediate layer shown in FIG. 3, for example, it is shown that the intermediate layer has an sea-island structure in which island portions composed of: the quasicrystal phase "$Mg_{32}(Zn, Al)_{49}$" as the Zn—Mg—Al alloy phase; $MgZn_2$ phase as the Zn—Mg alloy phase; and Mg phase as the metal phase; are surrounded by the sea portion composed of $Al_5Fe_2$ phase as the Al—Fe alloy phase.

As described above, in the SEM backscattered electron image of the intermediate layer shown in FIG. 3, respective phases can be distinguished from one another in gray scale. When the image is subjected to the computer image processing which is carried out in such a manner that changes occur only in the values of the above described three color parameters of the Al—Fe alloy phase, as described above, it is possible to obtain the area fractions of the respective phases (such as the Al—Fe alloy phase, the Zn—Mg—Al alloy phase, the Zn—Mg alloy phase, and the metal phase) in the SEM backscattered electron image.

The area fractions of the respective phases constituting the intermediate layer can also be calculated by binary-coded processing of the SEM backscattered electron image. Specifically, the area fractions of two distinguishable regions of black and white, in each phase, are determined from the "three parameter values of brightness, hue, and contrast" of each phase, in the SEM backscattered electron image. Another two distinguishable regions of black and white, in each phase, are then selected, and the area fractions of the two regions of black and white are determined. By repeating the described operations, and calculating the difference between the thus determined area fractions, it is also possible to obtain the area fraction of a target phase.

For example, in the case of the SEM backscattered electron image of the intermediate layer shown in FIG. 3, the calculation is carried out, specifically as follows.

The black portions as Mg phase are displayed in black, and the phases other than that are displayed in white, and the area fraction of the Mg phase is determined.

The white portions as $MgZn_2$ phase are displayed in white, and the phases other than that are displayed in black, and the area fraction of the $MgZn_2$ phase is determined.

The white portions as $MgZn_2$ phase and the light grey portions as the quasicrystal phase are displayed in white, and the phases other than those are displayed in black, and the total area fraction of the $MgZn_2$ phase and the quasicrystal phase is determined. Then the area fraction of the quasicrystal phase is determined by calculating the difference between the total area fraction of the $MgZn_2$ phase and the quasicrystal phase, and the area fraction of the $MgZn_2$ phase.

The area fraction of the dark grey portions as $Al_5Fe_2$ phase is determined by subtracting the total area fraction of the white portions as $MgZn_2$ phase, the light grey portions as the quasicrystal phase, and Mg phase, from the area fraction of the entire region.

The intermediate layer preferably has a thickness of from 5 to 500 μm. To form a coating layer having a sufficient corrosion resistance, and to prevent the occurrence of coating defects such as coating failure, the presence of an intermediate layer having a thickness of at least 5 μm or more is preferred. When the intermediate layer has a thickness of less than 5 μm, it is difficult to form a coating layer having a sufficient thickness, and the resulting coating layer may have an insufficient adhesion.

Further, the thickness of the intermediate layer has a relation to Al—Fe diffusion. Accordingly, in the case of forming a coating layer by a hot-dip coating method, for example, the thickness of the intermediate layer which can be formed by hot-dip coating, under normal operating conditions, is usually 500 μm or less. It is noted that the formation of an intermediate layer having a thickness of more than 500 μm is difficult, since the Fe component supplied from the steel product (base metal) fails to reach the intermediate layer.

From the viewpoint of improving the corrosion resistance of the coating layer and the intermediate layer, the intermediate layer more preferably has a thickness of 10 μm or more, and still more preferably 100 μm or more. At the same time, the intermediate layer preferably has a thickness of 200 μm or less, because an increase in the thickness of the intermediate layer may impair the appearance of the coating layer.

In a case in which the intermediate layer does not have the above described sea-island structure, the effect of sacrificial corrosion protection cannot be obtained even when the thickness of the intermediate layer is from 5 to 500 μm, and red rust is more likely to occur in the intermediate layer, at an early stage.

The ratio of the thickness of the intermediate layer to the thickness of the coating layer (the thickness of the intermediate layer/the thickness of the coating layer) is preferably from 0.2 to 4 times, and more preferably from 0.5 to 2 times.

Too high or too low a ratio of the thickness of the intermediate layer may cause the occurrence and the propagation of cracks, due to impact, at an interface between the coating layer and the intermediate layer, possibly resulting in the peeling of the coating layer. Therefore, it is preferred that the ratio of the thickness of the intermediate layer is adjusted within the range of from 0.2 to 4 times.

In a case in which the intermediate layer does not have the above described sea-island structure, cracks may occur and propagate at the interface between the coating layer and the intermediate layer, due to impact, even when the ratio of the thickness of the intermediate layer to the thickness of the coating layer is from 0.2 to 4 times, making the coating layer susceptible to peeling.

The thickness of the intermediate layer is measured as follows. Using an SEM (scanning electron microscope), a cross-sectional observation of the intermediate layer (namely, an observation of a region corresponding to a length of 2.5 mm in a direction parallel to the intermediate layer, in a cross section obtained by cutting the intermediate layer in the thickness direction thereof) is carried out. The observation is carried out at least in three similar visual fields. The thicknesses of the thickest portions and the thicknesses of the thinnest portions of the intermediate layer, observed in the respective three visual fields, are different, when observed at a magnification of about 100 times, as shown in FIG. 2, for example. An upper surface of the intermediate layer has a shape in the form of waves which vary depending on the locations. Examples of the method of calculating the mean value of the thickness of the intermediate layer include the following method. Specifically, the area of the cross section of the intermediate layer is first obtained by image processing. Subsequently, collinear approximation is carried out for both bottom and upper surfaces of the cross section of the intermediate layer, and the cross section is converted into a rectangle which has the interface between the intermediate layer and the base metal (steel sheet) as its one side (bottom side), and which has the same area. The length of the rectangle in the direction of height is defined as the mean value of the thickness. In this manner, the mean value of the values obtained from at least three visual fields is defined as the mean value of the thickness of the intermediate layer.

A sample to be used for the cross-sectional observation may be prepared by a known resin embedding method or cross-sectional polishing method.

Next, the coating layer will be described.

The coating layer includes from 8 to 50% of Mg, from 2.5 to 70.0% of Al, and from 0.30 to 5.00% of Ca, with the balance consisting of Zn and impurities.

Descriptions will be given below regarding the composition of the coating layer, limitations on numerical ranges of the composition, and the reasons for the limitations. "Mg: from 8 to 50%"

Mg is an element which improves the corrosion resistance of the coating layer. Mg is also an element responsible for hardening the coating layer, and improving the impact resistance and the wear resistance of the coating layer. At the same time, however, Mg is also an element which forms Mg phase which reduces the corrosion resistance of the coating layer. Accordingly, the content of Mg is set within the range of from 8 to 50%. The Mg content is preferably from 8 to 50%, more preferably from 10 to 45%, still more preferably from 15 to 35%, and particularly preferably from 15 to 25%.

Further, Mg is an element which promotes the formation of a quasicrystal phase having a high corrosion resistance in the coating layer. Thus, a Mg content within the range of from 8 to 50% facilitates the formation of the quasicrystal phase in the coating layer.

"Al: from 2.5 to 70.0%"

Al is an element which improves the corrosion resistance. Al is also an element necessary for increasing the thickness of the intermediate layer including an Al—Fe alloy phase. However, when the coating layer contains too large an amount of Al, red rust is more likely to occur. Accordingly, the content of Al is set within the range of from 2.5 to 70.0%. The Al content is preferably from 3 to 60%, more preferably from 5.0 to 50.0%, and still more preferably from 5.0 to 15.0%.

Further, a large amount of Al inhibits the formation of a quasicrystal phase having a high corrosion resistance, in the coating layer. Thus, an Al content within the range of from 2.5 to 70.0% facilitates the formation of the quasicrystal phase in the coating layer.

"Ca: from 0.30 to 5.00%"

Ca is an element which prevents the oxidation of Mg. In order to form a coating layer having a Mg content of 8% or more, it is necessary to use a coating bath having the same Mg content. In a case in which Ca is not incorporated into a coating bath having a Mg content of 8% or more, black oxide of Mg is formed within several minutes, in the atmosphere. At the same time, however, Ca itself is also easily oxidized, and has an adverse effect on the corrosion resistance of the coating layer. A large amount of Ca leads to a high tendency to interfere with the incorporation of Zn, which is a corrosion resistant element, into the Al—Fe alloy phase in the intermediate layer. Accordingly, the content of Ca is set within the range of from 0.30 to 5.00%. The Ca content is preferably from 0.50 to 3.00%.

Further, a large amount of Ca inhibits the formation of a quasicrystal phase having a high corrosion resistance, in the coating layer. Thus, a Ca content within the range of from 0.30 to 5.00% facilitates the formation of the quasicrystal phase in the coating layer.

"Balance: Zn and Impurities"

Zn in the balance is an element which improves the corrosion resistance. Further, Zn in the balance is responsible for imparting a certain degree of reactivity with the steel product (base metal), in a high-Mg coating bath, thereby accelerating the Al—Fe reaction. Still further, Zn in the balance is also an element which is necessary for reducing the speed of the Al—Fe reaction to a moderate degree when the Al concentration is high, and which contributes to the adhesion between the coating layer and the steel product (base metal). Accordingly, the content of Zn in the balance is preferably 20% or more, and more preferably 30% or more.

However, when Zn in the balance is contained in a large amount in the coating layer, the Al—Fe reaction between the coating layer and the base metal is accelerated, possibly resulting in a failure to form an intermediate layer having the sea-island structure. Accordingly, the content of Zn in the balance is preferably 70% or less, and more preferably 65% or less.

In addition, Zn is an element which promotes the formation of a quasicrystal phase having a high corrosion resistance in the coating layer. Thus, a Zn content within the range of from 20 to 70% facilitates the formation of the quasicrystal phase in the coating layer.

Impurities in the balance refer to components contained in raw materials, or components which are mixed during the production process, and which are not intentionally incorporated. For example, there is a case in which up to about 2% of Fe is mixed into the coating layer, as impurities, due to mutual atomic diffusion between the steel product (base metal) and the coating bath. However, it is noted that the performance of the coating layer is not affected, even when up to about 2% of Fe is contained in the coating layer.

The coating layer may contain one kind, or two or more kinds of the followings: from 0 to 3.50% of Y, from 0 to 3.50% of La, from 0 to 3.50% of Ce, from 0 to 0.50% of Si, from 0 to 0.50% of Ti, from 0 to 0.50% of Cr, from 0 to 0.50% of Co, from 0 to 0.50% of Ni, from 0 to 0.50% of V, from 0 to 0.50% of Nb, from 0 to 0.50% of Cu, from 0 to 0.50% of Sn, from 0 to 0.20% of Mn, from 0 to 0.50% of Sr, from 0 to 0.50% of Sb, from 0 to 0.50% of Cd, from 0 to 0.50% of Pb, and from 0 to 0.50% of B. However, the following Formula (A) and the following Formula (B) are satisfied:

$$Si+Ti+Cr+Co+Ni+V+Nb+Cu+Sn+Mn+Sr+Sb+Cd+Pb+B \leq 0.50\% \quad \text{Formula (A):}$$

$$Ca+Y+La+Ce \leq 5.00\%. \quad \text{Formula (B):}$$

In Formula (A) and Formula (B), the symbols of respective elements represent the contents of the respective elements in % by mass.

The above described Y, La, Ce, Si, Ti, Cr, Co, Ni, V, Nb, Cu, Sn, Mn, Sr, Sb, Cd, Pb and B can be contained in the coating layer without affecting the performance the coating layer, as long as Formula (A) and Formula (B) are satisfied. Of course, the coating layer does not necessarily contain these elements.

Y, La and Ce are elements which prevent the oxidation of Mg, as is Ca. However, Y, La and Ce themselves are also easily oxidized, and have an adverse effect on the corrosion resistance of the coating layer. Accordingly, one kind, or two or more kinds of Y, La and Ce may be contained in the coating layer, as long as Formula (B) is satisfied.

Further, Y, La and Ce are also elements which promote the formation of a quasicrystal phase having a high corrosion resistance in the coating layer, as is Ca. However, when the total content of Ca, Y, La and Ce is more than 5.0%, the formation of the quasicrystal phase ceases immediately. Therefore, even in the case of forming the quasicrystal phase in the coating layer, one kind, or two or more kinds of Y, La and Ce may be contained in the coating layer, as long as Formula (B) is satisfied.

Si is an element which improves the corrosion resistance. This is because Si binds to another element to form $Mg_2Si$, Ca—Si compounds (such as CaSi, $Ca_5Si_3$ and $Ca_2Si$) and the like, when contained in the coating layer, thereby allowing Mg and Ca to form crystal structures which are less susceptible to dissolution. However, in the present embodiment, Si hardly affects the performance of the coating layer, since Si and Ca are contained at low concentrations, and the area fractions of these phases in the coating layer are less than 5%. At the same time, Si is an element which slows the growth of the intermediate layer including the Al—Fe alloy phase. Accordingly, the content of Si is preferably from 0 to 0.500%, more preferably from 0 to 0.050%, still more preferably from 0 to 0.005%, and particularly preferably from 0% (namely, Si is not incorporated), in order to form an intermediate layer having a thickness of from 5 to 500 μm.

Sn, Cr and B are elements which serve as reaction auxiliaries that accelerate the Al—Fe reaction. Therefore, in order to form an intermediate layer having a thickness of from 5 to 500 μm, one kind, or two or more kinds of Sn, Cr and B may be contained in the coating layer, to the extent that the performance of the coating layer is not adversely affected, namely, as long as Formula (B) is satisfied.

The composition of the coating layer is measured by high frequency glow-discharge spectroscopy (GDS). Specifically, the measurement is carried out as follows.

A sample is cut out from the coated steel product, such that the surface of the sample on which the coating layer is formed, has a size of a 30 mm square. The thus obtained sample is used as a sample for use in high frequency glow-discharge spectroscopy (GDS). Argon ion sputtering is carried out from the side of sample on which the coating layer and the intermediate layer are formed, to obtain a plot of elemental intensity in the depth direction. Meanwhile, standard samples are prepared from pure metal sheets or the like of the respective elements to be measured, and a plot of elemental intensity is obtained from the standard samples, in advance. Based on the comparison of the two plots of elemental intensity, the elemental intensities are converted into the concentrations (contents) of constituent elements in the coating layer and the intermediate layer. The measurement is carried out under conditions of an analysis area of 4 mm or more in diameter, and a sputtering speed within the range of from about 0.04 to 0.1 μm/sec.

The plot of elemental intensity of a surface layer extending up to a depth of 5 μm from the surface of the coating layer is disregarded, and the mean value of the concentration of each element is obtained from the plot of elemental intensity of a region at a depth of from 5 μm to 10 μm from the surface of the coating layer. The above described operation is carried out for the purpose of eliminating the effect of an oxide layer formed on the surface layer of the coating layer.

Subsequently, the above described operation is repeated at 10 or more locations, and the mean value of the concentrations of each element in the coating layer, obtained at the respective locations (namely, the mean value of the mean value of the concentration of each element in the coating layer, obtained by the above described operation) is defined as the content of each element in the coating layer.

The metallographic structure of the coating layer will now be described.

The metallographic structure of the coating layer is not particularly limited. Examples of the metallographic structure mainly constituting the coating layer include: a quasicrystal phase, $MgZn_2$ phase, $Mg_2Zn_3$ phase (the same substance as $Mg_4Zn_7$), $Mg_{51}Zn_{20}$ phase, Mg phase, MgZn phase and Al phase.

The quasicrystal phase exhibits excellent corrosion resistant properties. Further, when the quasicrystal phase is allowed to corrode in a corrosion acceleration test or the like, a corrosion product having a high barrier effect is formed, and protects the steel product (base metal) from corrosion for a long period of time. The formation of the corrosion product having a high barrier effect is related to the ratio of Zn—Mg—Al components contained in the quasicrystal phase. When the composition of the components of the coating layer satisfy Formula: Zn>(Mg+Al+Ca) (wherein the symbols of respective elements represent the contents of the respective elements in % by mass), the barrier effect of the corrosion product is increased.

In contrast, $MgZn_2$ phase and $Mg_2Zn_3$ phase (the same substance as $Mg_4Zn_7$) have a lower effect of improving the corrosion resistance, as compared to that of the quasicrystal phase. However, these phases have a certain degree of corrosion resistance. Further, $MgZn_2$ phase and $Mg_2Zn_3$ phase contain a high amount of Mg, and are excellent in alkali corrosion resistance. In particular, when the quasicrystal phase, $MgZn_2$ phase and $Mg_2Zn_3$ phase coexist in the coating layer, an oxide film on the surface layer of the coating layer has an increased stability in a highly alkaline environment (pH: from 13 to 14), thereby exhibiting a particularly high alkali corrosion resistance.

In addition, in a coated steel product which is not subjected to major processing, inclusion of a large amount of quasicrystal phase in the coating layer is suitable from the viewpoint of corrosion resistance. However, the quasicrystal phase is an extremely hard phase, and the coating layer including a large amount of quasicrystal phase may include some cracks within the phase. Therefore, in a case in which the coated steel product includes a tightening portion for a bolt connection, or in a case in which the coated steel product is exposed to various types of flying objects due to being used in an outdoor environment, it is preferred to impart a certain degree of ductility to the coating layer. In order to impart both the corrosion resistance and ductility to the coating layer, it is preferred to allow Al phase, which is soft and plastically deformable, to coexist with the quasicrystal phase, in the coating layer. When the coating layer is imparted with ductility due to the presence of Al phase, the impact resistance is increased, resulting in a decreased amount of peeling of the coating layer.

Based on the above, the coating layer preferably has the following metallographic structure (1) or (2):

(1) A metallographic structure composed of a quasicrystal phase, $MgZn_2$ phase, $Mg_2Zn_3$ phase, and a balance structure.

Examples of the balance structure in the metallographic structure of (1) include $Mg_{51}Zn_{20}$ phase, MgZn phase, $Mg_2Zn_3$ phase, Zn phase, and Al phase.

In the metallographic structure of (1), the area fraction of the quasicrystal phase is preferably from 3 to 70%, and more preferably from 10 to 70%, from the viewpoint of improving the corrosion resistance, impact resistance, and wear resistance. Further, from the same viewpoint, the total area fraction of the quasicrystal phase, $MgZn_2$ phase, and $Mg_2Zn_3$ phase is preferably from 3 to 100%, and more preferably from 90 to 100%.

In particular, when the total area fraction of the quasicrystal phase, $MgZn_2$ phase, and $Mg_2Zn_3$ phase is increased, the resulting coating layer exhibits, for example, such an excellent alkali corrosion resistance that the amount of corrosion is almost 0, even in a strongly alkaline environment (for example, in ammonia water, caustic soda, or the like).

(2) A metallographic structure composed of a quasicrystal phase, Al phase, and a balance structure.

Examples of the balance structure in the metallographic structure of (2) include $MgZn_2$ phase, $Mg_2Zn_3$ phase, $Mg_{51}Zn_{20}$ phase, MgZn phase, $Mg_2Zn_3$ phase, and Zn phase.

In the metallographic structure of (2), the area fraction of the quasicrystal phase is preferably from 25 to 45%, and more preferably from 30 to 45%, from the viewpoint of improving the corrosion resistance and impact resistance. Further, from the same viewpoint, the total area fraction of the quasicrystal phase and Al phase is preferably from 75 to 100%, and more preferably from 90 to 100%.

It is noted that there is a case in which a coating layer having a metallographic structure of (1) or (2) contains, as the balance structure, another intermetallic compound phase such as $Al_4Ca$ phase, $Al_2Zn_2Ca$ phase, or $Al_3ZnCa$ phase. However, the other intermetallic compound is an intermetallic compound phase formed depending on the concentration of Ca, and the area fraction thereof in the coating layer is less than 5% in the present embodiment. Therefore, there is no substantial effect on the performance of the coating layer.

The area fractions of the respective phases in the coating layer are area fractions determined in a cross section of the coating layer (a cross section obtained by cutting the coating layer in the thickness direction thereof). The area fractions of the respective phases in the coating layer can be measured in the same manner as the area fractions of the respective phases (the Al—Fe alloy phase, the Zn—Mg—Al alloy phase, the Zn—Mg alloy phase, and the metal phase) in the intermediate layer.

The coating layer preferably has a thickness of 20 μm or more, and more preferably 50 μm or more. When the corrosion resistance of the coating layer is compared with that of the intermediate layer, the coating layer has a better corrosion resistance. Therefore, from the viewpoint of ensuring a sufficient corrosion resistance of the coated steel product, the thickness of the coating layer is preferably adjusted to 20 μm or more, and more preferably 50 μm or more. At the same time, the thickness of the coating layer is preferably adjusted to 100 μm or less, since an increase in the thickness of the coating layer may impair the appearance of the coating layer.

The thickness of the coating layer is measured in the same manner as the measurement of the thickness of the intermediate layer, by carrying out a cross-sectional observation of the coating layer (namely, an observation of three visual fields in a region corresponding to a length of 2.5 mm in a direction parallel to the coating layer, in a cross section obtained by cutting the coating layer in the thickness direction thereof), using an SEM (scanning electron microscope).

The coating layer is preferably a hot-dip coating layer formed by hot-dip coating as will be described later.

Next, a description will be given below regarding the definition of the quasicrystal phase common to the coating layer and the intermediate layer.

The quasicrystal phase is defined as a quasicrystal phase in which the Mg content, the Zn content, and the Al content, in atomic %, satisfy Formula: $0.5 \leq Mg/(Zn+Al) \leq 0.83$. In other words, the quasicrystal phase is defined as a quasicrystal phase in which the ratio Mg:(Zn+Al), which is the ratio of the number of Mg atoms to the total number of Zn atoms and Al atoms, is within the range of from 3:6 to 5:6. It is considered that the ratio Mg:(Zn+Al) is about 4:6.

The amounts of chemical components of the quasicrystal phase can be calculated by a quantitative analysis using TEM-EDX (Transmission Electron Microscope-Energy Dispersive X-ray Spectroscopy), or by a quantitative analysis using EPMA (Electron Probe Micro-Analyzer) mapping. It is noted that it is not easy to define the quasicrystal phase by an exact chemical formula, in the same manner as defining an intermetallic compound. This is because, a repeating lattice unit of the quasicrystal phase cannot be defined as can a unit lattice of a crystal, and also because, it is difficult to identify the atomic positions of Zn and Mg.

The quasicrystal phase is a crystal structure first discovered by Daniel Shechtman in 1982, and has an atomic arrangement in the form of an icosahedron. This crystal structure is an aperiodic crystal structure having a specific rotational symmetry, such as five-fold symmetry, which cannot be formed in a normal metal or alloy, and is known as a crystal structure equivalent to an aperiodic structure represented by a three-dimensional Penrose pattern. This metallic substance is identified, usually, by obtaining an electron beam diffraction image in the form of a radial regular decagon derived from the icosahedron structure, from the phase, by an electron beam observation using a TEM. For example, the TEM electron beam diffraction image shown in FIG. 4 is obtained only from the quasicrystal, and cannot be obtained from any other crystal structure. Therefore, the quasicrystal phase can be distinguished from a MgZn alloy phase, such as $MgZn_2$ phase.

The quasicrystal phase exhibits a diffraction peak which can be identified as $Mg_{32}(Zn, Al)_{49}$ phase, by X-RAY diffraction using JCPDS card: PDF No. 00-019-0029, or No. 00-039-0951, in a simple manner.

(Method of Producing Coated Steel Product)

Next, one example of the method of producing the coated steel product according to the embodiment will be described.

The coated steel product according to the embodiment is preferably produced by hot-dip coating using a hot-dip coating bath having the same composition (composition excluding impurities) as the composition of the coating layer. Further, hot-dip coating is preferably carried out by one-stage coating.

In hot-dip coating, in general, the Al—Fe reaction is inactive in a hot-dip coating bath (high Mg concentration coating bath) containing Mg at a high concentration of 8% or more. This is because, as described in the paragraph 0007 in Patent Document 1, not only selective oxidation of Al but also selective oxidation of Mg occurs in the hot-dip coating bath, when carrying out hot-dip coating in the atmospheric environment, and the thus formed oxides interfere with the contact between the steel product and the coating bath components. It is also because, in a case in which the steel product is subjected to a flux treatment before carrying out the hot-dip coating, "a chloride such as zinc chloride, ammonium chloride or tin chloride" used as a flux, reacts with Al to reduce the effect of the flux. Particularly when the hot-dip coating bath contains Mg, not only Al but also Mg reacts with a chloride, to cause the reaction of a larger amount of chlorides. As a result, the effect of the flux is further reduced.

Accordingly, in the hot-dip coating using the high Mg concentration coating bath, there exists a period of time during which the base metal (steel product) is not at all wetted by the hot-dip coating bath, and no reaction occurs (hereinafter, this period of time is also referred to as "unreacted time"). Further, under ordinary hot-dip coating conditions (for example, conditions of a coating bath temperature of less than 550° C., and the like), Mg acts as an inert element in the atmospheric environment, and a Mg oxide film, which interferes with the wettability of the base metal (steel product) with the coating bath, is formed at the interface between the base metal (steel product) and the coating bath.

Therefore, it has been considered that, in a case in which hot-dip coating is carried out using the high Mg concentration coating bath, the unreacted time continues infinitely, and thus it is difficult to form a coating layer, after having formed an intermediate layer having an appropriate thickness.

However, by reducing the unreacted time, the Fe—Al reaction (the alloying reaction between Al and Fe) can be accelerated, and it becomes possible to form a coating layer, after having formed an intermediate layer having an appropriate thickness, even in the case of the hot-dip coating using the high Mg-concentration hot-dip coating bath.

Specifically, in order to achieve a reduction in unreacted time, the coating bath temperature is preferably 550° C. or higher, and more preferably 600° C. or higher. The coating bath temperature is preferably a temperature equal to or higher than melting points of the coating components plus 50° C., and more preferably a temperature within the range of from the melting points plus 50° C. to 100° C., from the viewpoint of ensuring coating properties as well as the wettability between the steel product and the coating bath.

When the hot-dip coating is carried out at a coating bath temperature of less than 550° C., the unreacted time is extended, making it difficult to initiate the Al—Fe reaction.

On the other hand, too high a coating bath temperature may cause a rapid oxidization of the steel product at the surface of the coating bath. As a result, there is a case in which scales are formed on the surface of the steel product, causing a deterioration in wettability as well as an adverse effect on the quality of the steel product. Accordingly, the coating bath temperature is preferably 650° C. or lower.

Dipping is carried out preferably for a dipping time of 1 minute or more, more preferably 5 minutes or more.

In a case in which the dipping time is less than 1 minute, the steel product (base metal) is not wetted by the coating bath even when the hot-dip coating is carried out at a coating bath temperature of 550° C. or higher, making it difficult to allow a sufficient Fe—Al reaction to proceed.

On the other hand, too long a dipping time leads to the formation of a fragile intermediate layer due to an excessive growth. As a result, an internal stress is generated due to temperature difference, immediately after pulling up the steel product from the coating bath, and cracks are more likely to occur on the surface of the coating layer. In addition, when the steel product or the like has a low thickness, there is a case in which the entire steel product (base metal) may collapse. Accordingly, the dipping time is preferably less than 30 minutes.

In order to achieve a reduced unreacted time, in the method of producing the coated steel product according to the embodiment, it is preferred to use at least one of the following methods (1) to (9), in addition to: increasing the coating bath temperature; increasing the Al concentration and the Zn concentration in the coating bath; and decreasing oxygen potential on the surface of the coating bath. A further reduction in the unreacted time can be achieved by using any of these methods.

(1) A method of heating the steel product before carrying out hot-dip coating. The heating is preferably carried out such that the steel product has a surface temperature of 200° C. or higher, and more preferably 400° C. or higher. The heating is preferably carried out in an inert atmosphere. The steel product is preferably a low-alloy steel.

(2) A method of vibrating and/or rotating the steel product in the coating bath.

(3) A method of stirring the coating bath in which the steel product is dipped.

(4) A method of using a steel product which has been subjected to at least one of a flux treatment, a shot blast treatment, a shot peening treatment, or a pickling treatment, before carrying out the dip coating.

(5) A method of using a steel product whose surface (the surface on which the coating layer and the intermediate layer are to be formed) has a small crystal grain size. The crystal grain size is preferably less than 5 μm, and more preferably less than 1 μm.

(6) A method of using a steel product in which the dislocation density of the surface (the surface on which the coating layer and the intermediate layer are to be formed) is enhanced by grinding processing.

(7) A method of using a Cu—Sn-substituted coated steel product or a Zn-coated steel product (a coated steel product in which the amount of Zn deposited is 40 $g/m^2$ or less).

(8) A method of using a coating bath containing a reaction auxiliary for accelerating the Al—Fe reaction. Examples of the reaction auxiliary include Sn, Cr, and B. These elements must be added not to the steel product, but to the hot-dip coating bath. It is preferred that the content of Sn is 0.50% or less, the content of Cr is 0.50% or less, and the content of B is 0.50% or less, so that the properties of the hot-dip coating are not adversely affected. However, the contents of these elements are adjusted within the range satisfying the above described Formula (B).

(9) A method of using a coating bath in which the content of Si, which interferes with the Al—Fe reaction, is limited. The Si content is preferably from 0 to 0.500%, more preferably from 0 to 0.050%, still more preferably from 0 to 0.005%, and particularly preferably 0% (namely, Si is not incorporated).

When the steel product is subjected to the hot-dip coating in which the coating bath having a Mg content of 8% or more is used to achieve a "reduction in unreacted time" as described above, a hot-dip coating layer is formed on the surface of the steel product, and along therewith, an intermediate layer having the above described sea-island structure is formed between the steel product and the hot-dip coating layer. Although not clear, the mechanism thereof is assumed to be as follows.

First, when the steel product is dipped in the coating bath having a Mg content of 8% or more, initially, a Mg oxide film, which interferes with the wettability of the steel product (base metal) by the coating bath, is formed on the surface of the steel product, making the steel product in a state incapable of being wetted by the hot-dip coating bath (see FIG. 5 (1)).

Thereafter, due to the above described reduction in unreacted time, the surface of the steel product starts to be wetted by the hot-dip coating bath within a short period of time. When the steel product starts to be wetted by the hot-dip coating bath, first, the Al—Fe reaction is initiated, starting from locations having a low interface energy, such as crystal grain boundaries and irregular portions, on the surface of the steel product (see FIG. 5 (2)).

Subsequently, the Al—Fe reaction proceeds to allow the growth of an Al—Fe alloy phase. As a result, a liquid phase of the coating bath which is deficient in Al (having a low Al content) (hereinafter, also referred to as "Al-deficient coating liquid phase") is formed around the thus grown Al—Fe alloy phase (see FIG. 5 (3)). Meanwhile, in the offshore of the coating bath, the distal end portions of the grown Al—Fe alloy phase react with a liquid phase of the coating bath which is rich in Al, resulting in an irregular growth of the Al—Fe alloy phase.

Specifically, the diffusion of Al atoms from the offshore of the coating bath towards the vicinity of the surface of the steel product is slow. However, in the range of the coating bath temperature of 550° C. or higher, the dissolution of Fe from the surface of the steel product (base metal) occurs actively, once the Al—Fe reaction starts. Further, the rate of dissolution of Fe from the surface of the steel product (base metal) is increased. Fe easily reaches the offshore of the coating bath. At the locations at which the Al—Fe reaction occurs, Fe is supplied at a higher rate than Al. Under this circumstance, the Al—Fe reaction and the formation of the Al-deficient liquid phase actively occur in the coating bath having a Mg content of 8% or more, and the growth of the Al—Fe alloy phase proceeds irregularly. It is noted that, in the case of using a coating bath having a Mg content of less than 8%, the Al—Fe alloy phase does not grow irregularly, but grow in the form of a layer.

As a result, the Al—Fe alloy phase grows while partially incorporating the Al-deficient coating liquid phase (see FIG. 5 (4)). In other words, the Al-deficient coating liquid phase partially remains in the Al—Fe alloy phase. It is noted that there is a case in which a trace amount of Zn as a coating component is incorporated into the Al—Fe alloy phase.

Thereafter, the "Al-deficient coating liquid phase" surrounded by the Al—Fe alloy phase solidifies, and transforms into an intermetallic compound having the lowest component concentration. As a result, at least a Zn—Mg—Al alloy phase (quasicrystal phase) is formed. In addition to the formation of the Zn—Mg—Al alloy phase (quasicrystal phase), there is a case in which phase transformation or phase separation occurs due to equilibrium solidification, to result in the formation of an intermetallic compound (such as a Zn—Mg alloy phase), a metal phase (such as Mg phase) and the like. Further, an intermetallic compound containing a small amount of Fe, and the like, are also formed, as a result of the dissolution of Fe in the Al-deficient coating liquid phase.

In the above described manner, it is thought that an intermediate layer having a sea-island structure constituted by a sea portion composed of an Al—Fe alloy phase, and "island portions including a Zn—Mg—Al alloy phase" and surrounded by the sea portion, is formed. Thereafter, coating components are solidified on the surface of the intermediate layer having the sea-island structure, to form a coating layer.

In FIG. 5, reference numeral 10 indicates the steel product, reference numeral 12 indicates the coating bath, reference numeral 12A indicates the Mg oxide film, reference numeral 12B indicates the Al-deficient liquid phase, and reference numeral 14 indicates the Al—Fe alloy phase.

A description will be given below regarding other suitable conditions in the method of producing the coated steel product according to the embodiment.

In the method of producing the coated steel product according to the embodiment, for example, a steel product is dipped in a "coating bath" which is obtained by using an alloy having a predetermined component composition and prepared in a vacuum melting furnace or the like, and melting the alloy in the atmosphere. When there is no structural problem for carrying out dipping, a lid or the like can be provided over the coating bath, so that nitrogen substitution can be carried out to lower the oxygen potential, thereby reducing the unreacted time of the Al—Fe reaction.

It is preferred that the coating bath is used in a sufficiently large volume, with respect to the size of the steel product. For example, it is preferred that the volume of the coating bath is at least 5 L or more, for coating a steel product having a length of 100 mm×a width of 50 mm×a thickness of 2 mm.

Before being dipped in the coating bath, the steel product is preferably subjected to a surface cleaning treatment (for example, a surface cleaning treatment in which degreasing, a pickling treatment, a water washing treatment, and a drying treatment are carried out). Specifically, for example, the steel product is dipped in 10% hydrochloric acid for 10 minutes or more, so that a rigid oxide film (black scales, scales) formed on the surface layer of the steel product is peeled off. Subsequently, the steel product is further subjected to pickling and water washing. Thereafter, a dryer, a drying furnace or the like is used to remove water remaining on the steel product.

In a case in which the steel product is subjected to a treatment for increasing the dislocation density, such as a blast treatment or a brush grind treatment, for the purpose of reducing the unreacted time, it is preferred to perform a flux treatment, a shot blast treatment, a shot peening treatment, a pickling treatment, a brush grinding or the like, on the steel product whose oxide film has been removed by the above described treatments. After the completion of these treatments, it is preferred that the treated steel product is used, as it is, as a dipped steel product, or alternatively, subjected to a post-treatment in which only a dry washing treatment or the like is carried out, and then used as a dipped steel product.

During dipping in the coating bath, it is preferable to vibrate and/or rotate the steel product. The vibration and/or rotation of the steel product play(s) a roll of reducing the unreacted time as described above, as well as a roll of preventing the coated steel product from having a poor appearance. In particular, in a case in which the steel product is subjected to a flux treatment using a chloride as a flux, there is a case in which Mg-based chlorides and the like are formed on the surface of the steel product, due to the reaction between the flux (chloride) and the coating components, resulting in an impaired surface appearance. Therefore, the method of vibrating and/or rotating the steel product is effective, also from this viewpoint.

Before and after, as well as during, the dipping of the steel product in the coating bath, it is preferred to remove dross formed on the surface of the coating bath. By removing the dross, it is possible to prevent the coated steel product from having a poor appearance.

After being dipped in the coating bath, the steel product is preferably pulled up at a pulling speed of 100 mm/s or less, and more preferably 50 mm/s or less. When the steel product is pulled up at a high pulling speed, there is a case in which the thickness of the coating layer formed on the intermediate layer is increased excessively, possibly causing the peeling of the coating layer.

After being pulled up from the coating bath, the steel product is cooled from the temperature thereof immediately after being pulled up (the coating bath temperature) to room temperature, at a predetermined cooling rate. The temperature as used above is the surface temperature of the steel product.

The cooling rate of the steel product after being pulled up from the coating bath is not particularly limited. For example, the steel product may be cooled by dipping in water immediately after being pulled up from the coating bath, or may be cooled naturally.

Alternatively, the steel product may be cooled at the following cooling rate, in order to efficiently form the quasicrystal phase in the intermediate layer (island portions of the sea-island structure thereof), and in the coating layer, of the coated steel product.

In the temperature range of from the temperature of the steel product immediately after being pulled up (the coating bath temperature) to 500° C., it is preferred to cool the steel product within 8 seconds. In the temperature range of from the temperature of the steel product immediately after being pulled up to 500° C., Al migrates rapidly toward the interface between the steel product and the coating layer, to form the Al—Fe alloy phase (namely, the intermediate layer). Accordingly, by cooling the steel product from the temperature thereof immediately after being pulled up to 500° C. within 8 seconds, Al in the coating layer is prevented from being incorporated into the intermediate layer. As a result, the Al concentration in the coating layer before solidification can be adjusted to an appropriate level, to result in a state suitable for the formation of the quasicrystal phase.

In order to achieve the cooling of the steel product within 8 seconds, as described above, it is preferred to provide a cooling apparatus immediately above the coating bath. The cooling apparatus is preferably a cooling apparatus capable of blowing an inert gas, a mist cooling apparatus, or the like, in order to prevent the oxidation of the coating components.

In the temperature range of from 500° C. to 350° C., after pulling up the steel product, the steel product is preferably cooled at a cooling rate of 5° C./sec or less, in order to keep the steel product in the temperature range for 30 seconds or more. In the temperature range of less than 500° C. but 350° C. or more, the Al—Fe alloy phase (namely, the intermediate layer) ceases to grow, and the most stable phase is the quasicrystal phase. Accordingly, adjusting the cooling rate to 5° C./sec or less, in this temperature range, facilitates the formation of the quasicrystal phase in the intermediate layer (island portions of the sea-island structure thereof), and in the coating layer, of the coated steel product. It is noted that when the cooling rate is adjusted to more than 5° C./sec, the steel product is cooled before the precipitation of quasicrystal phase, and there is a case in which the ratio of the quasicrystal phase is extremely reduced, or no quasicrystal phase is included.

In the temperature range of from 350° C. to 250° C., after pulling up the steel product, the steel product is preferably cooled at a cooling rate of 10° C./sec or more. The temperature range of less than 350° C. but 250° C. or more is a stable range for intermetallic compound phases (such as $Mg_2Zn_3$ phase and MgZn phase) and a metal phase (such as Mg phase), rather than for the quasicrystal phase. Further, in this temperature range, there is a case in which the quasicrystal phase may transform into an intermetallic compound phase (such as $Mg_2Zn_3$ phase or MgZn phase). Accordingly, increasing the cooling rate to 10° C./sec or more, in this temperature range, facilitates the maintenance of the area fractions of the quasicrystal phase formed in the intermediate layer (island portions of the sea-island structure thereof), and that in the coating layer, of the coated steel product.

In the temperature range of from 250° C. to room temperature, after pulling up the steel product, the cooling rate is not particularly limited. This is because, in the temperature range of from 250° C. to room temperature, the atomic diffusion slows down due to low temperature, and this temperature range is below a temperature required for the formation or the decomposition of any phase.

In the production of the coated steel product, a post-treatment may be carried out after the formation of the coating layer.

Examples of the post-treatment include various types of treatments for treating the surface of the coated steel product, such as: a treatment in which an upper layer coating is carried out, a chromate treatment, a non-chromate treatment, a phosphate treatment, a treatment for improving lubricity, and a treatment for improving weldability. Further, examples of the post-treatment also include a treatment in which a resin coating (such as a coating of a polyester resin, an acrylic resin, a fluorine resin, a vinyl chloride resin, an urethane resin, or an epoxy resin) is coated by a method such as roll coating, spray coating, curtain flow coating, dip coating, or a film laminate method (for example, a film laminate method which is used when layering a resin film such as an acrylic resin film) to form a coating film.

Examples

Examples which are one example of the present disclosure will now be described. Conditions used in Examples are one example of conditions used for confirming the feasibility and effects of the present disclosure. The present disclosure is in no way limited by the one example of conditions. In the present disclosure, various conditions can be used, as long as the gist of the present disclosure is not deviated, and the object of the present disclosure is achieved (Tests Nos. 1E to 34E and 35C to 39C)

Coated steel products were produced by hot-dip coating, in accordance with production conditions shown in Table 1. Specifically, the production was carried out as follows.

As the coating bath to be used, eight types of the following coating baths A to K having predetermined compositions were prepared. The amount of each coating bath was set to 16 L. The components of each coating bath were confirmed by: collecting a solidified piece of the coating bath; dissolving the chips of the solidified piece in an acid; and observing the resulting solution by an ICP emission spectrochemical analysis.

Further, as the steel product to be subjected to hot-dip coating, a sheet of general carbon steel (a steel sheet with mill scale, SS400, defined in JIS G 3101 (2010)) having a size of: 70 mm sheet width×150 mm sheet length×2.3 mm sheet thickness was used, in each of the tests.

Types of coating baths (in the following compositions of the coating baths, the respective numerical values described before the respective symbols of elements are the percentages by mass of the respective elements, and the percentage by mass of Zn is the balance. The same applies hereinafter)—

A: composition=Zn-50% Mg-2.5% Al-5.00% Ca
B: composition=Zn-35% Mg-5.0% Al-3.00% Ca
C: composition=Zn-25% Mg-10.0% Al-2.00% Ca
D: composition=Zn-15% Mg-15.0% Al-1.00% Ca
E: composition=Zn-10% Mg-55.0% Al-0.50% Ca
F: composition=Zn-8% Mg-67.0% Al-0.50% Ca-0.05% Si
G: composition=Zn-8% Mg-67.0% Al-0.30% Ca-0.05% Si
H: composition=Zn-8% Mg-67.0% Al-0.30% Ca-0.50% Cr
I: composition=Zn-8% Mg-67.0% Al-0.30% Ca-0.50% Sn
J: composition=Zn-8% Mg-67.0% Al-0.15% Ca-0.05% Si
K: composition=Zn-5% Mg-70.0% Al-0.50% Ca First, in each of the tests, the steel product was dipped in 10% hydrochloric acid for 10 minutes or more, to peel off the oxide film formed on the surface layer of the steel product. Thereafter, the steel product was sufficiently drained, followed by drying. Then the entire surface of the steel product was ground with a #600 belt sander, and the grinding chips are blown off with a dryer.

Next, the steel product was fixed on a fixture of a lifting apparatus for dipping. The lifting apparatus is capable of dipping the steel product into the coating bath and pulling up the steel product therefrom at a constant speed. The lifting apparatus is capable of causing microvibration in the steel product dipped in the coating bath, by ultrasonic waves emitted from the fixture. Further, a thermocouple was attached to the steel product, so that a temperature history during hot-dip coating can be monitored at all times. A nitrogen gas-blowing mechanism was provided to the lifting apparatus, so that $N_2$ gas can be blown to the steel product immediately after being pulled up.

Subsequently, the dross on the surface of the coating bath was scraped off manually, and then the steel product was dipped into each corresponding coating bath which is of the type, and has the coating bath temperature, shown in Table 1, by the lifting apparatus at a dipping rate of 100 mm/sec. As soon as the steel product was completely dipped in the coating bath, ultrasonic waves were emitted, and the vibration of the steel product was maintained throughout the dipping. The surface dross formed during the dipping was scooped with a metal dipper, and removed immediately.

After the elapse of each dipping time shown in Table 1, the steel product was pulled up from the coating bath at each pulling speed shown in Table 1. The thickness of the coating layer was adjusted by the pulling speed.

Subsequently, in the case of hot-dip coating using the coating bath A or B, $N_2$ gas was blown to the steel product, after pulling up from the coating bath, so as to cool the steel product at each cooling rate shown in Table 1. As soon as the temperature reached 350° C., the steel product was immediately dipped in 20 L of water for further cooling. In contrast, in the case of hot-dip coating using any one of the coating baths C to K, the steel product was cooled to 250° C. at each cooling rate shown in Table 1, by adjusting the amount of $N_2$ gas to be blown to the steel product, after pulling up from the coating bath.

In each of the tests Nos. 4E, 17E, 21E, and 27E, a flux treatment was carried out. The flux treatment was carried out as follows. After being subjected to pickling and surface grinding, and before being dipped into the coating bath, the steel product was washed with hot water at 80° C., and then dipped in the flux "$ZnCl_2/NaCl/SnC_{l2}.H_2O$=215/25/5 (g/L)" for 1 minute, followed by drying at 150° C.

In the test No. 37C, a coated steel product was produced by hot-dip coating using a zinc coating bath as the coating bath (denoted in the Table as "Hot-dip coating with zinc").

In the test No. 38C, a coated steel product was produced by two-stage hot-dip coating. In a first stage, hot-dip coating was carried out using a zinc coating bath as the coating bath, and in a second stage, hot-dip coating was carried out using a coating bath having the composition of Zn-6% Al-1% Mg.

In the test No. 39C, a coated steel product was also produced by two-stage hot-dip coating. In the first stage, hot-dip coating was carried out using a zinc coating bath as the coating bath, and in the second stage, hot-dip coating was carried out using a coating bath having the composition of Zn-11% Al-3% Mg-0.2% Si.

(Tests Nos. 40C to 45C)

Coated steel products were prepared by hot-dip coating using a Sendzimir process, in accordance with the production conditions shown in Table 1. The hot-dip coating was carried out using a batch type hot-dip coating apparatus manufactured by RHESCA Co., LTD. Specifically, the production was carried out as follows.

As the coating bath to be used, six types of the above described coating baths A to F were prepared. The amount of each coating bath was set to 8 L.

Further, as the steel product to be subjected to hot-dip coating, a sheet of general carbon steel (a steel sheet obtained by pickling a steel sheet with mill scale, SS400, defined in JIS G 3101 (2010)) having a size of: 100 mm sheet width×150 mm sheet length×2.3 mm sheet thickness was used, in each of the tests.

First, the steel product was heated from room temperature to 800° C. by electrical heating, under $N_2$—$H_2$ (5%) conditions (dew point: −40° or less, oxygen concentration: less than 25 ppm), and maintained at that temperature for 60 seconds. Subsequently, the steel product was cooled to the coating bath temperature plus 10° C. by blowing $N_2$ gas thereto, and immediately dipped into each corresponding coating bath which is of the type, and has the coating bath temperature, shown in Table 1.

The dipping time in the coating bath was set to one second, and after pulling up the steel product from the coating bath, the steel product was subjected to $N_2$ gas wiping. The pulling speed and a $N_2$ gas wiping pressure were adjusted such that the coating layer has a thickness of 20 μm (±1 μm).

During the process from the dipping in the coating bath to the $N_2$ gas wiping, the batch type coating apparatus was operated at a high speed, and the process was completed within one second.

In each of the tests No. 40C and No. 41C, $N_2$ gas was blown to the steel product after the completion of the $N_2$ gas wiping, and the steel product was cooled to 250° C. at an average cooling rate of 15° C./sec. Further, in each of the tests Nos. 42C to 45C, $N_2$ gas was blown to the steel product, and the coated steel product was cooled at the cooling rate shown in Table 1.

In each of the tests No. 40C and No. 41C, the produced coated steel product was heated again to 500° C. in an air furnace so as to melt the surface of the coating layer again, and then subjected to a treatment in which the coated steel product was cooled with water at the cooling rate shown in Table 1.

(Various Measurements)

The properties (composition, metallographic structure, and thickness) of the intermediate layer and the coating layer of each of the resulting coated steel products were measured, in accordance with the methods described above. The results are shown in Table 2 and Table 3.

Since it has been confirmed that the composition of each coating layer was almost the same as the composition of each coating bath used, except for impurities, the description thereof is omitted.

(Various Evaluations)

The following evaluations were carried out for each of the resulting coated steel products. The results are shown in Table 3.

—Corrosion Resistance of Intermediate Layer—

To evaluate the corrosion resistance of the intermediate layer, the coating layer on the surface to be evaluated of the coated steel product was completely removed by surface machining. The steel product in which the coating layer had been removed so as to leave only the intermediate layer was subjected to an SST test. The corrosion resistance was evaluated 3,000 hours later (JIS Z 2371). Evaluation criteria are as follows.

Excellent: red rust is not observed on the surface to be evaluated

Very Good: the area ratio of red rust observed on the surface to be evaluated is 5% or less Good: the area ratio of red rust observed on the surface to be evaluated is 10% or less Bad: the area ratio of red rust observed on the surface to be evaluated is more than 10%

It is noted that, in each of the coated steel products of the tests No. 40 to No. 43, the results of the cross-sectional observation of the intermediate layer and the coating layer revealed that the intermediate layer had a thickness of 1 μm or less, and thus the corrosion resistance of the intermediate layer was not evaluated.

(Corrosion Resistance of Coating Layer in Alkaline Environment)

The corrosion resistance of the coating layer was evaluated as follows. The coated steel product was cut out in a size of 150×70 mm, and cut end surfaces thereof were sealed. The resulting coated steel product was then dipped in a 1 mol/L aqueous solution of NaOH at 40° C. for 24 hours. Twenty-four hours later, the coated steel product was retrieved from the solution, and a corrosion product formed on the surface of the coating layer was removed by dipping into 20% chromic acid at normal temperature for 15 minutes. The determination of corrosion weight loss was carried out by measuring the weight of the coated steel product before and after the test. The thus obtained corrosion weight loss was converted into a corrosion thickness loss, using a theoretical density of each alloy, and the corrosion resistance in alkaline environment was evaluated. The evaluation criteria are as follows.

Excellent: the corrosion thickness loss is less than 1 μm

Very Good: the corrosion thickness loss is from 1 μm to 2 μm

Good: the corrosion thickness loss is more than 2 μm but equal to or less than 4 μm Bad: the corrosion thickness loss is more than 4 μm (Impact Resistance of Coating Layer)

The impact resistance of the coating layer was evaluated using a gravel test, by observing the peeling of the coating layer after applying an impact thereto. First, using a gravel tester (manufactured by Suga Test Instruments Co., Ltd.), a total of 100 kg of No. 7 crushed stone was allowed to collide with an area of 100×100 mm of the surface to be evaluated of the coated steel product, under conditions of a normal temperature environment, a distance of 30 cm, an atmospheric pressure of 3.0 kg/cm$^2$, and an angle of 90°. Thereafter, an EPMA-Fe element mapping image of the surface to be evaluated of the coated steel product was captured, and the total area ratio of the portion of the surface at which the base metal is exposed (hereinafter, referred to as "base metal-exposed portion") and the portion of the surface at which the intermediate layer is exposed (hereinafter, referred to as "intermediate layer-exposed portion") was calculated. The evaluation criteria are as follows.

Excellent: the steel product (base metal)-exposed portion and the intermediate layer-exposed portion are not observed Very Good: the total area ratio of the steel product (base metal)-exposed portion and the intermediate layer-exposed portion is 5% or less Good: the total area ratio of the steel product (base metal)-exposed portion and the intermediate layer-exposed portion is 10% or less Bad: the total area ratio of the steel product (base metal)-exposed portion and the intermediate layer-exposed portion is more than 10%

(Wear Resistance of Coating Layer)

The wear resistance of the coating layer was evaluated as follows. Using a pin-on-disk friction and wear tester (FDR-2100) manufactured by RHESCA Co., LTD., a linear scar was formed on the coated steel product, using an SUS304 Ball having a diameter of 3/16 inch, under the conditions of a load of 1,000 gf, a radius of 20 mm, a rate of 1 rpm, 5 rotations in clockwise direction, and a temperature of 25° C. The portion of the linear scar was embedded and polished, and a maximum recessed depth from the surface of the coating layer was measured. The evaluation criteria are as follows.

Excellent: the maximum recessed depth is less than 5 μm

Very Good: the maximum recessed depth is from 5 μm to 7.5 μm

Good: the maximum recessed depth is more than 7.5 μm but equal to or less than 10.0 μm Bad: the maximum recessed depth is more than 10 μm

TABLE 1

| | | | | | | Cooling Rate (° C./s) | | | |
|---|---|---|---|---|---|---|---|---|---|
| No. | Type of coating bath | Flux treatment | Coating bath temperature (° C.) | Dipping time (sec) | Pulling speed (mm/sec) | From Coating bath temperature to 500° C. | From 500° C. to 350° C. | From 350° C. to 250° C. | Type of coating |
| 1E | A | — | 600 | 60 | 15 | 20 | 5 | 1,000 or more (submerged) | Hot-dip coating |
| 2E | A | — | | 180 | | 25 | 4 | 1,000 or more (submerged) | Hot-dip coating |
| 3E | A | — | | 300 | | 20 | 5 | 1,000 or more (submerged) | Hot-dip coating |
| 4E | A | Yes | | 200 | | 25 | 4 | 1,000 or more (submerged) | Hot-dip coating |
| 5E | A | — | | 400 | | 20 | 3 | 1,000 or more (submerged) | Hot-dip coating |
| 6E | A | — | | 500 | | 25 | 5 | 1,000 or more (submerged) | Hot-dip coating |
| 7E | A | — | | 600 | | 20 | 4 | 1,000 or more (submerged) | Hot-dip coating |
| 8E | A | — | | 750 | | 25 | 5 | 1,000 or more (submerged) | Hot-dip coating |
| 9E | A | — | | 1000 | | 20 | 3 | 1,000 or more (submerged) | Hot-dip coating |

TABLE 1-continued

| No. | Type of coating bath | Flux treatment | Coating bath temperature (° C.) | Dipping time (sec) | Pulling speed (mm/sec) | Cooling Rate (° C./s): From Coating bath temperature to 500° C. | Cooling Rate (° C./s): From 500° C. to 350° C. | Cooling Rate (° C./s): From 350° C. to 250° C. | Type of coating |
|---|---|---|---|---|---|---|---|---|---|
| 10E | B | — | 550 | 350 | 10 | 20 | 5 | 1,000 or more (submerged) | Hot-dip coating |
| 11E | B | — | | 250 | | 10 | 4 | 1,000 or more (submerged) | Hot-dip coating |
| 12E | B | — | | 500 | | 20 | 5 | 1,000 or more (submerged) | Hot-dip coating |
| 13E | B | — | | 600 | | 10 | 3 | 1,000 or more (submerged) | Hot-dip coating |
| 14E | B | — | | 750 | | 15 | 5 | 1,000 or more (submerged) | Hot-dip coating |
| 15E | C | — | 600 | 100 | 50 | 25 | 4 | 50 | Hot-dip coating |
| 16E | C | — | | 180 | | 20 | 5 | 30 | Hot-dip coating |
| 17E | C | Yes | | 80 | | 20 | 3 | 20 | Hot-dip coating |
| 18E | C | — | | 240 | | 25 | 5 | 25 | Hot-dip coating |
| 19E | C | — | | 300 | | 20 | 4 | 10 | Hot-dip coating |
| 20E | D | — | 600 | 150 | 100 | 20 | 5 | 25 | Hot-dip coating |
| 21E | D | Yes | | 70 | | 15 | 3 | 20 | Hot-dip coating |
| 22E | D | — | | 200 | | 25 | 5 | 50 | Hot-dip coating |
| 23E | D | — | | 250 | | 25 | 4 | 20 | Hot-dip coating |
| 24E | D | — | | 300 | | 25 | 5 | 25 | Hot-dip coating |
| 25E | E | — | 650 | 70 | 5 | 30 | 5 | 50 | Hot-dip coating |
| 26E | E | — | | 80 | | 30 | 3 | 10 | Hot-dip coating |
| 27E | E | Yes | | 80 | | 30 | 4 | 25 | Hot-dip coating |
| 28E | E | — | | 90 | | 25 | 5 | 20 | Hot-dip coating |
| 29E | E | — | | 100 | | 25 | 4 | 20 | Hot-dip coating |
| 30E | F | — | 650 | 60 | 15 | 25 | 5 | 20 | Hot-dip coating |
| 31E | F | — | | 70 | | 25 | 4 | 20 | Hot-dip coating |
| 32E | G | — | 650 | 70 | 15 | 25 | 5 | 50 | Hot-dip coating |
| 33E | H | — | 650 | 70 | 15 | 25 | 5 | 50 | Hot-dip coating |
| 34E | I | — | 650 | 70 | 15 | 25 | 5 | 50 | Hot-dip coating |
| 35C | J | — | 650 | Unable to perform initial make-up of bath due to oxidation of Mg | | | | | |
| 36C | K | — | 650 | 80 | 15 | 25 | 5 | 20 | Hot-dip coating |
| 37C | — | — | 480 | 240 | 15 | — | 15 (from coating bath temperature to 350° C.) | 10 | Hot-dip coating with zinc |
| 38C | — | — | First stage: 480 Second stage: 450 | First stage: 240 Second stage: 300 | First stage: 15 Second stage: 15 | — | 15 (from coating bath temperature to 350° C.) | 10 | Zinc (first stage) Zn-6% Al-1% Mg (second stage) |
| 39C | — | — | First stage: 480 Second stage: 450 | First stage: 240 Second stage: 300 | First stage: 15 Second stage: 15 | | 15 (from coating bath temperature to 350° C.) | 10 | Zinc (first stage) Zn-11% Al-3% Mg-0.2% S I (second stage) |
| 40C | A | — | 450 | 1 | — | — | 5 | 1,000 or more (submerged) | Sendzimir process (Hot-dip coating) |
| 41C | B | | 500 | 1 | — | — | 5 | 1,000 or more (submerged) | Sendzimir process (Hot-dip coating) |
| 42C | C | | 550 | 1 | — | 20 | 3 | 20 | Sendzimir process (Hot-dip coating) |
| 43C | D | | 550 | 1 | — | 25 | 5 | 20 | Sendzimir process (Hot-dip coating |
| 44C | E | | 570 | 1 | — | 25 | 5 | 20 | Sendzimir process (Hot-dip coating) |
| 45C | F | | 570 | 1 | — | 25 | 5 | 20 | Sendzimir process (Hot-dip coating) |

TABLE 2

| No. | Coating layer: Thickness (μm) | Metallographic structure (area fraction %): Quasicrystal phase | $MgZn_2$ phase | $Mg_2Zn_3$ phase | Al phase | Balance |
|---|---|---|---|---|---|---|
| 1E | 50 | 3 | 0 | 0 | 0 | 97 |
| 2E | 50 | 5 | 0 | 0 | 0 | 95 |

TABLE 2-continued

| | Coating layer | | | | | |
|---|---|---|---|---|---|---|
| | Thickness | Metallographic structure (area fraction %) | | | | |
| No. | (μm) | Quasicrystal phase | $MgZn_2$ phase | $Mg_2Zn_3$ phase | Al phase | Balance |
| 3E | 50 | 4 | 0 | 0 | 0 | 96 |
| 4E | 50 | 3 | 0 | 0 | 0 | 97 |
| 5E | 50 | 5 | 0 | 0 | 0 | 95 |
| 6E | 50 | 3 | 0 | 0 | 0 | 97 |
| 7E | 50 | 3 | 0 | 0 | 0 | 97 |
| 8E | 50 | 4 | 0 | 0 | 0 | 96 |
| 9E | 50 | 5 | 0 | 0 | 0 | 95 |
| 10E | 30 | 35 | 3 | 2 | 0 | 60 |
| 11E | 30 | 40 | 2 | 3 | 0 | 55 |
| 12E | 30 | 33 | 3 | 4 | 0 | 60 |
| 13E | 30 | 38 | 2 | 3 | 0 | 57 |
| 14E | 30 | 42 | 4 | 1 | 0 | 53 |
| 15E | 75 | 57 | 32 | 8 | 0 | 3 |
| 16E | 75 | 62 | 27 | 7 | 0 | 4 |
| 17E | 75 | 66 | 21 | 9 | 0 | 4 |
| 18E | 75 | 63 | 24 | 9 | 0 | 4 |
| 19E | 75 | 66 | 23 | 7 | 0 | 4 |
| 20E | 100 | 12 | 82 | 2 | 0 | 4 |
| 21E | 100 | 15 | 80 | 1 | 0 | 4 |
| 22E | 100 | 13 | 82 | 2 | 0 | 3 |
| 23E | 100 | 15 | 83 | 2 | 0 | 0 |
| 24E | 100 | 10 | 85 | 2 | 0 | 3 |
| 25E | 20 | 35 | 0 | 0 | 65 | 0 |
| 26E | 20 | 33 | 0 | 0 | 63 | 4 |
| 27E | 20 | 42 | 0 | 0 | 56 | 2 |
| 28E | 20 | 35 | 0 | 0 | 61 | 4 |
| 29E | 20 | 34 | 0 | 0 | 63 | 3 |
| 30E | 50 | 25 | 0 | 0 | 72 | 3 |
| 31E | 50 | 26 | 0 | 0 | 71 | 3 |
| 32E | 50 | 28 | 0 | 0 | 70 | 2 |
| 33E | 50 | 26 | 0 | 0 | 70 | 4 |
| 34E | 50 | 26 | 0 | 0 | 70 | 4 |
| 35C | Unable to perform initial make-up of bath due to oxidation of Mg | | | | | |
| 36C | 50 | 0 | 8 | 0 | 73 | 19 |
| 37C | 50 | 0 | 0 | 0 | 0 | 100 |
| 38C | 50 | 0 | 3 | 0 | 32 | 65 |
| 39C | 50 | 0 | 7 | 0 | 68 | 25 |
| 40C | 20 | 2 | 0 | 0 | 0 | 98 |
| 41C | 20 | 40 | 3 | 2 | 0 | 55 |
| 42C | 20 | 58 | 28 | 5 | 0 | 9 |
| 43C | 20 | 14 | 80 | 2 | 0 | 4 |
| 44C | 20 | 35 | 2 | 0 | 60 | 3 |
| 45C | 20 | 29 | 1 | 0 | 70 | 0 |

TABLE 3

| | Intermediate layer | | | | | | | | | | |
|---|---|---|---|---|---|---|---|---|---|---|---|
| | | | | | | | Metallographic structure (sea-island structure) | | | | |
| | | | | | | | Island portions | | | | |
| | Thickness | Composition (%) | | | | | Quasicrystal phase (percentage within island | $MgZn_2$ phase (percentage within island | Mg phase (percentage within island | Sea portion $Al_5Fe_2$ phase | Intermediate layer thickness/coating |
| No. | (μm) | Zn | Mg | Al | Ca | Fe | portions) | portions) | portions) | (area fraction %) | layer thickness |
| 1E | 5 | 13.3 | 12.5 | bal. | 1.3 | 33.0 | 25 | 25 | 48 | 75 | 0.1 |
| 2E | 10 | 17.2 | 17.5 | bal. | 1.8 | 28.6 | 27 | 23 | 46 | 65 | 0.2 |
| 3E | 50 | 21.1 | 22.5 | bal. | 2.3 | 24.2 | 24 | 24 | 49 | 55 | 1 |
| 4E | 50 | 21.1 | 22.5 | bal. | 2.3 | 24.2 | 22 | 26 | 49 | 55 | 1 |
| 5E | 100 | 15.2 | 15.0 | bal. | 1.5 | 30.8 | 23 | 25 | 49 | 70 | 2 |
| 6E | 200 | 13.3 | 12.5 | bal. | 1.3 | 33.0 | 24 | 24 | 49 | 75 | 4 |
| 7E | 300 | 19.1 | 20.0 | bal. | 2.0 | 26.4 | 24 | 24 | 47 | 60 | 6 |
| 8E | 400 | 11.3 | 10.0 | bal. | 1.0 | 35.2 | 26 | 25 | 48 | 80 | 8 |
| 9E | 500 | 13.3 | 12.5 | bal. | 1.3 | 33.0 | 27 | 24 | 48 | 75 | 10 |
| 10E | 50 | 22.2 | 12.3 | bal. | 1.1 | 28.6 | 42 | 38 | 16 | 65 | 1.7 |
| 11E | 50 | 19.6 | 10.5 | bal. | 0.9 | 30.8 | 47 | 40 | 10 | 70 | 1.7 |

TABLE 3-continued

| | Intermediate layer | | | | | | | | | |
|---|---|---|---|---|---|---|---|---|---|---|
| | | | | | | | Metallographic structure (sea-island structure) | | | |
| | | | | | | | Island portions | | | |
| No. | Thickness (μm) | Composition (%) Zn | Mg | Al | Ca | Fe | Quasicrystal phase (percentage within island portions) | $MgZn_2$ phase (percentage within island portions) | Mg phase (percentage within island portions) | Sea portion $Al_5Fe_2$ phase (area fraction %) | Intermediate layer thickness/coating layer thickness |
| 12E | 100 | 19.6 | 10.5 | bal. | 0.9 | 30.8 | 45 | 40 | 12 | 70 | 3.3 |
| 13E | 200 | 14.2 | 7.0 | bal. | 0.6 | 35.2 | 49 | 39 | 9 | 80 | 6.7 |
| 14E | 300 | 16.9 | 8.8 | bal. | 0.8 | 33.0 | 50 | 42 | 6 | 75 | 10.0 |
| 15E | 25 | 19.6 | 10.5 | bal. | 0.9 | 30.8 | 42 | 54 | 2 | 70 | 0.3 |
| 16E | 50 | 16.9 | 8.8 | bal. | 0.8 | 33.0 | 47 | 50 | 1 | 75 | 0.7 |
| 17E | 50 | 19.6 | 10.5 | bal. | 0.9 | 30.8 | 40 | 40 | 2 | 70 | 0.7 |
| 18E | 100 | 14.2 | 7.0 | bal. | 0.6 | 35.2 | 43 | 52 | 3 | 80 | 1.3 |
| 19E | 150 | 11.5 | 5.3 | bal. | 0.5 | 37.4 | 44 | 51 | 2 | 85 | 2.0 |
| 20E | 50 | 26.4 | 5.3 | bal. | 0.4 | 28.6 | 7 | 92 | — | 65 | 0.5 |
| 21E | 50 | 29.7 | 6.0 | bal. | 0.4 | 26.4 | 6 | 93 | — | 60 | 0.5 |
| 22E | 100 | 23.2 | 4.5 | bal. | 0.3 | 30.8 | 8 | 91 | — | 70 | 1.0 |
| 23E | 150 | 19.9 | 3.8 | bal. | 0.3 | 33.0 | 7 | 92 | — | 75 | 1.5 |
| 24E | 200 | 23.2 | 4.5 | bal. | 0.3 | 30.8 | 7 | 91 | — | 70 | 2.0 |
| 25E | 10 | 14.4 | 3.5 | bal. | 0.2 | 28.6 | 82 | 15 | — | 65 | 0.5 |
| 26E | 20 | 12.8 | 3.0 | bal. | 0.2 | 30.8 | 83 | 13 | — | 70 | 1.0 |
| 27E | 50 | 12.8 | 3.0 | bal. | 0.2 | 30.8 | 84 | 16 | — | 70 | 2.5 |
| 28E | 40 | 11.3 | 2.5 | bal. | 0.1 | 33.0 | 83 | 15 | — | 75 | 2.0 |
| 29E | 80 | 9.7 | 2.0 | bal. | 0.1 | 35.2 | 85 | 14 | — | 80 | 4.0 |
| 30E | 5 | 6.6 | 1.2 | bal. | 0.1 | 37.4 | 93 | 5 | — | 85 | 0.1 |
| 31E | 10 | 5.6 | 0.8 | bal. | 0.1 | 39.6 | 92 | 7 | — | 90 | 0.2 |
| 32E | 10 | 6.7 | 1.2 | bal. | 0.0 | 37.4 | 90 | 8 | — | 85 | 0.2 |
| 33E | 15 | 7.0 | 1.3 | bal. | 0.0 | 36.4 | 90 | 8 | — | 87 | 0.3 |
| 34E | 15 | 7.1 | 1.3 | bal. | 0.0 | 36.7 | 91 | 7 | — | 83 | 0.3 |
| 35C | Unable to perform initial make-up of bath due to oxidation of Mg | | | | | | | | | | |
| 36C | 50 | 1.5 | 0.0 | bal. | 0.0 | 47.5 | — | — | — | 100 | 1.0 |
| 37C | 50 | 2.0 | 0.0 | bal. | 0.0 | 48.0 | — | — | — | 100 | 1.0 |
| 38C | 50 | 6.0 | 0.0 | bal. | 0.0 | 59.0 | — | — | — | 100 | 1.0 |
| 39C | 50 | 5.0 | 0.0 | bal. | 0.0 | 63.0 | — | — | — | 100 | 1.0 |
| 40C | less than 0.1 | — | — | — | — | — | — | — | — | — | — |
| 41C | less than 0.1 | — | — | — | — | — | — | — | — | — | — |
| 42C | 0.5 | — | — | — | — | — | — | — | — | 100 | 1.0 |
| 43C | 1 | — | — | — | — | — | — | — | — | 100 | 1.0 |
| 44C | 3 | 1.3 | 0.0 | bal. | 0.0 | 47.7 | — | — | — | 100 | 1.0 |
| 45C | 3 | 1.6 | 0.0 | bal. | 0.0 | 48.4 | — | — | — | 100 | 1.0 |

TABLE 4

| No. | Corrosion resistance of intermediate layer | Corrosion resistance of coating layer in alkaline environment | Impact resistance of coating layer | Wear resistance of coating layer |
|---|---|---|---|---|
| 1E | Good | Excellent | Very Good | Very Good |
| 2E | Very Good | Excellent | Excellent | Very Good |
| 3E | Very Good | Excellent | Excellent | Very Good |
| 4E | Very Good | Excellent | Excellent | Very Good |
| 5E | Excellent | Excellent | Excellent | Very Good |
| 6E | Excellent | Excellent | Excellent | Very Good |
| 7E | Excellent | Excellent | Very Good | Very Good |
| 8E | Excellent | Excellent | Very Good | Very Good |
| 9E | Excellent | Excellent | Very Good | Very Good |
| 10E | Very Good | Excellent | Excellent | Very Good |
| 11E | Very Good | Excellent | Excellent | Very Good |
| 12E | Excellent | Excellent | Excellent | Very Good |
| 13E | Excellent | Excellent | Very Good | Very Good |
| 14E | Excellent | Excellent | Very Good | Very Good |
| 15E | Very Good | Excellent | Excellent | Excellent |
| 16E | Very Good | Excellent | Excellent | Excellent |
| 17E | Very Good | Excellent | Excellent | Excellent |
| 18E | Excellent | Excellent | Excellent | Excellent |

TABLE 4-continued

| No. | Corrosion resistance of intermediate layer | Corrosion resistance of coating layer in alkaline environment | Impact resistance of coating layer | Wear resistance of coating layer |
|---|---|---|---|---|
| 19E | Excellent | Excellent | Excellent | Excellent |
| 20E | Excellent | Excellent | Excellent | Excellent |
| 21E | Excellent | Excellent | Excellent | Excellent |
| 22E | Excellent | Excellent | Excellent | Excellent |
| 23E | Excellent | Excellent | Excellent | Excellent |
| 24E | Excellent | Excellent | Excellent | Excellent |
| 25E | Very Good | Very Good | Excellent | Good |
| 26E | Very Good | Very Good | Excellent | Good |
| 27E | Very Good | Very Good | Excellent | Good |
| 28E | Very Good | Very Good | Excellent | Good |
| 29E | Very Good | Very Good | Excellent | Good |
| 30E | Good | Good | Excellent | Good |
| 31E | Very Good | Good | Excellent | Good |
| 32E | Very Good | Good | Excellent | Good |
| 33E | Very Good | Good | Excellent | Good |
| 34E | Very Good | Good | Excellent | Good |
| 35C | Unable to perform initial make-up of bath due to oxidation of Mg | | | |
| 36C | Bad | Bad | Bad | Bad |

TABLE 4-continued

| No. | Corrosion resistance of intermediate layer | Corrosion resistance of coating layer in alkaline environment | Impact resistance of coating layer | Wear resistance of coating layer |
|---|---|---|---|---|
| 37C | Bad | Bad | Bad | Bad |
| 38C | Bad | Bad | Bad | Bad |
| 39C | Bad | Bad | Bad | Bad |
| 40C | — | Excellent | Bad | Very Good |
| 41C | — | Excellent | Bad | Very Good |
| 42C | — | Excellent | Bad | Excellent |
| 43C | — | Excellent | Bad | Excellent |
| 44C | Bad | Very Good | Bad | Good |
| 45C | Bad | Good | Bad | Good |

In Table 3, the numerical values in the respective columns of "Quasicrystal phase", "$MgZn_2$ phase", and "Mg phase" under the category of "Island portions", represent the area fractions of the respective phases in the island portions. In a case in which a numerical value is shown, it means that the corresponding phase is present, and the intermediate layer has the sea-island structure. The description "–" indicates the absence of the corresponding phase.

Further, the numerical value "100" in the column of "Sea portion" indicates that the intermediate layer does not have the sea-island structure.

In addition, the description "bal." in the column of "Al", indicates that the Al content is an amount corresponding to the balance containing impurities.

It can be seen from the above described results that, in each of the coated steel products of the tests Nos. 1E to 34E, the intermediate layer has the sea-island structure, and the corrosion resistance of the intermediate layer itself is high. The above results show that the corrosion resistance after the occurrence of damage or cracks in the coating layer is also high.

Further, it can be seen that the coated steel products of the tests Nos. 1E to 34E have a high corrosion resistance in an alkaline environment, a high impact resistance, and a high abrasion resistance.

In contrast, in each of the coated steel products of the tests Nos. 35C to 45C, it can be seen that the intermediate layer does not have the sea-island structure, and the corrosion resistance of the intermediate layer itself is low. The above results show that the corrosion resistance after the occurrence of damage or cracks in the coating layer is also low.

In particular, in each of the coated steel products of the tests 40C to 45C, it can be seen that the corrosion resistance of the intermediate layer itself and the impact resistance of the coating layer are low, since the intermediate layer has a low thickness and the sea-island structure is not formed therein.

It is noted that, in the test No. 15E, when at least one of Y, La, Ce, Si, Ti, Cr, Co, Ni, V, Nb, Cu, Sn, Mn, Sr, Sb, Cd, Pb, or B was incorporated into the coating bath within the range satisfying Formula (A) and Formula (B) to carry out the test, it has been confirmed that the evaluation results similar to those obtained in the test No. 15E were obtained.

What is claimed is:

1. A coated steel product comprising:

a steel product;

a coating layer that is coated on a surface of the steel product, and that comprises, by mass, from 8 to 50% of Mg, from 2.5 to 70.0% of Al, from 0.30 to 5.00% of Ca, from 0 to 3.50% of Y, from 0 to 3.50% of La, from 0 to 3.50% of Ce, from 0 to 0.50% of Si, from 0 to 0.50% of Ti, from 0 to 0.50% of Cr, from 0 to 0.50% of Co, from 0 to 0.50% of Ni, from 0 to 0.50% of V, from 0 to 0.50% of Nb, from 0 to 0.50% of Cu, from 0 to 0.50% of Sn, from 0 to 0.20% of Mn, from 0 to 0.50% of Sr, from 0 to 0.50% of Sb, from 0 to 0.50% of Cd, from 0 to 0.50% of Pb, and from 0 to 0.50% of B, with a balance consisting of Zn and impurities, wherein the following Formula (A) and the following Formula (B) are satisfied:

$$Si+Ti+Cr+Co+Ni+V+Nb+Cu+Sn+Mn+Sr+Sb+Cd+Pb+B \leq 0.50\% \quad \text{Formula (A):}$$

$$Ca+Y+La+Ce \leq 5.00\% \quad \text{Formula (B):}$$

wherein, in Formula (A) and Formula (B), symbols of respective elements represent contents of the respective elements in % by mass;

an intermediate layer interposed between the steel product and the coating layer, wherein the intermediate layer has a sea-island structure constituted by a sea portion composed of an Al—Fe alloy phase, and island portions including a Zn—Mg—Al alloy phase having a Mg content of 8% by mass or more, and wherein the sea portion composed of the Al—Fe alloy phase has an area fraction of from 55 to 90%; and the intermediate layer has a thickness of 10 μm to 500 μm.

2. The coated steel product according to claim 1, wherein the sea portion is composed of $Al_5Fe_2$ phase as the Al—Fe alloy phase, and wherein the island portions are composed of a quasicrystal phase as the Zn—Mg—Al alloy phase, and $MgZn_2$ phase, or composed of the quasicrystal phase as the Zn—Mg—Al alloy phase, the $MgZn_2$ phase, and Mg phase.

3. The coated steel product according to claim 2, wherein a ratio of a thickness of the intermediate layer to a thickness of the coating layer is from 0.2 to 4.

4. The coated steel product according to claim 2, wherein the Mg content in the coating layer is 15% by mass or more, and the Mg content in the Zn—Mg—Al alloy phase is 15% by mass or more.

5. The coated steel product according to claim 2, wherein the coating layer is a hot-dip coating layer.

6. The coated steel product according to claim 1, wherein a ratio of a thickness of the intermediate layer to a thickness of the coating layer is from 0.2 to 4.

7. The coated steel product according to claim 6, wherein the Mg content in the coating layer is 15% by mass or more, and the Mg content in the Zn—Mg—Al alloy phase is 15% by mass or more.

8. The coated steel product according to claim 6, wherein the coating layer is a hot-dip coating layer.

9. The coated steel product according to claim 1, wherein the Mg content in the coating layer is 15% by mass or more, and the Mg content in the Zn—Mg—Al alloy phase is 15% by mass or more.

10. The coated steel product according to claim 9, wherein the coating layer is a hot-dip coating layer.

11. The coated steel product according to claim 1, wherein the coating layer is a hot-dip coating layer.

* * * * *